US009891548B2

(12) United States Patent
Hase et al.

(10) Patent No.: US 9,891,548 B2
(45) Date of Patent: Feb. 13, 2018

(54) IMAGE FORMING METHOD, TONER, AND IMAGE FORMING APPARATUS

(71) Applicants: Takamasa Hase, Tokyo (JP); Yukiko Iwasaki, Kanagawa (JP); Minoru Masuda, Shizuoka (JP); Tsuneyasu Nagatomo, Shizuoka (JP); Kenji Yoneda, Shizuoka (JP)

(72) Inventors: Takamasa Hase, Tokyo (JP); Yukiko Iwasaki, Kanagawa (JP); Minoru Masuda, Shizuoka (JP); Tsuneyasu Nagatomo, Shizuoka (JP); Kenji Yoneda, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 104 days.

(21) Appl. No.: 14/729,180

(22) Filed: Jun. 3, 2015

(65) Prior Publication Data

US 2015/0378272 A1 Dec. 31, 2015

(30) Foreign Application Priority Data

Jun. 27, 2014 (JP) ..... 2014-132190

(51) Int. Cl.

| | |
|---|---|
| ***G03G 13/20*** | (2006.01) |
| ***G03G 13/08*** | (2006.01) |
| ***G03G 9/087*** | (2006.01) |
| ***G03G 15/20*** | (2006.01) |
| ***G03G 15/00*** | (2006.01) |
| *G03G 15/08* | (2006.01) |
| *G03G 15/16* | (2006.01) |

(52) U.S. Cl.

CPC ..... *G03G 13/20* (2013.01); *G03G 9/08755* (2013.01); *G03G 9/08795* (2013.01); *G03G 9/08797* (2013.01); *G03G 13/08* (2013.01); *G03G 15/2057* (2013.01); *G03G 15/6591* (2013.01); *G03G 15/08* (2013.01); *G03G 15/16* (2013.01); *G03G 2215/0129* (2013.01)

(58) Field of Classification Search

CPC ..... G03G 15/6591; G03G 15/2057; G03G 13/20; G03G 13/08

USPC ..... 430/123.52, 123.53, 123.54, 124.32, 430/124.51

See application file for complete search history.

(56) References Cited

U.S. PATENT DOCUMENTS

| | | | | |
|---|---|---|---|---|
| 5,520,993 | A * | 5/1996 | Lambert | G03G 7/0006 428/195.1 |
| 5,721,083 | A | 2/1998 | Masuda et al. | |
| 6,406,826 | B1 | 6/2002 | Suzuki et al. | |
| 2002/0155366 | A1 | 10/2002 | Mochizuki et al. | |
| 2002/0160290 | A1 | 10/2002 | Sugiura et al. | |
| 2003/0152857 | A1 | 8/2003 | Sugiura et al. | |
| 2003/0186154 | A1 | 10/2003 | Suzuki et al. | |
| 2003/0232266 | A1 | 12/2003 | Sugiura et al. | |
| 2005/0064310 | A1 | 3/2005 | Masuda et al. | |
| 2005/0277048 | A1* | 12/2005 | Tomita | G03G 15/2064 430/110.3 |
| 2006/0051692 | A1 | 3/2006 | Hasegawa et al. | |
| 2006/0063081 | A1 | 3/2006 | Nagatomo et al. | |
| 2006/0063092 | A1 | 3/2006 | Hasegawa et al. | |
| 2006/0068306 | A1 | 3/2006 | Shu et al. | |
| 2006/0093943 | A1 | 5/2006 | Shu et al. | |
| 2007/0218383 | A1 | 9/2007 | Seshita et al. | |
| 2007/0275315 | A1 | 11/2007 | Nagatomo et al. | |
| 2007/0281234 | A1* | 12/2007 | Isobe | G03G 9/0804 430/109.1 |
| 2008/0070144 | A1 | 3/2008 | Nagatomo et al. | |
| 2008/0096116 | A1 | 4/2008 | Utsumi et al. | |
| 2009/0123857 | A1 | 5/2009 | Shu et al. | |
| 2009/0142094 | A1 | 6/2009 | Sawada et al. | |
| 2010/0075245 | A1 | 3/2010 | Watanabe et al. | |
| 2010/0119255 | A1 | 5/2010 | Seshita et al. | |
| 2011/0294058 | A1 | 12/2011 | Shiba et al. | |
| 2012/0070777 | A1 | 3/2012 | Makabe et al. | |
| 2012/0264049 | A1 | 10/2012 | Masuda et al. | |
| 2012/0270147 | A1 | 10/2012 | Katoh et al. | |
| 2013/0130171 | A1 | 5/2013 | Watanabe et al. | |
| 2013/0243488 | A1 | 9/2013 | Kojima et al. | |
| 2013/0244155 | A1 | 9/2013 | Satoh et al. | |
| 2013/0244156 | A1 | 9/2013 | Kojima et al. | |
| 2013/0273188 | A1 | 10/2013 | Takahashi et al. | |
| 2014/0038100 | A1 | 2/2014 | Katoh et al. | |

(Continued)

FOREIGN PATENT DOCUMENTS

| | | |
|---|---|---|
| JP | 2005-062473 | 3/2005 |
| JP | 2006-195106 | 7/2006 |

(Continued)

OTHER PUBLICATIONS

WIPO machine-assisted English-language translation of JP 2015-148760 (pub. Aug. 2015).*

*Primary Examiner* — Janis L Dote

(74) *Attorney, Agent, or Firm* — Oblon, McClelland, Maier & Neustadt, L.L.P.

(57) ABSTRACT

An image forming method is provided. The method includes the steps of forming an electrostatic latent image on a photoconductor; developing the electrostatic latent image into a toner image with a toner; transferring the toner image onto a recording medium having a smoothness of 20 s or less; and fixing the toner image on the recording medium. The toner exhibits an adhesion force of 100 gf or more, where the adhesion force is the maximum value of a pull force between a layer of the toner and standard paper determined by a tacking test with a probe temperature of 140° C.

5 Claims, 3 Drawing Sheets

(56) References Cited

U.S. PATENT DOCUMENTS

| | | | | |
|---|---|---|---|---|
| 2014/0051019 | A1 | 2/2014 | Sekiguchi et al. | |
| 2014/0072349 | A1 | 3/2014 | Sakashita et al. | |
| 2014/0140731 | A1 | 5/2014 | Hozumi et al. | |
| 2014/0141110 | A1 | 5/2014 | Katoh et al. | |
| 2014/0220485 | A1 | 8/2014 | Kojima et al. | |
| 2014/0234767 | A1 | 8/2014 | Awamura et al. | |
| 2014/0242514 | A1 | 8/2014 | Inoue et al. | |
| 2014/0270874 | A1* | 9/2014 | Hase | G03G 15/2064 399/329 |
| 2014/0342283 | A1 | 11/2014 | Yamamoto et al. | |
| 2014/0356780 | A1* | 12/2014 | Kawamura | G03G 9/08724 430/109.3 |
| 2014/0363184 | A1 | 12/2014 | Santo et al. | |
| 2015/0227098 | A1* | 8/2015 | Kikuchi | G03G 15/2057 399/333 |

FOREIGN PATENT DOCUMENTS

| | | | |
|---|---|---|---|
| JP | 2010-152124 | | 7/2010 |
| JP | 2015-148760 | * | 8/2015 |
| WO | WO 2015/034028 A1 | * | 3/2015 |

* cited by examiner

IMAGE FORMING METHOD, TONER, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2014-132190, filed on Jun. 27, 2014, in the Japan Patent Office, the entire disclosure of which is hereby incorporated by reference herein.

BACKGROUND

Technical Field

The present disclosure relates to an image forming method, a toner, and an image forming apparatus.

Description of the Related Art

As image forming apparatus which forms images with toner, electrophotographic image forming apparatus such as printer is widely used. In the electrophotographic image forming apparatus, an electrostatic latent image formed on a photoconductor is developed into a toner image with toner. The toner image is transferred onto a recording medium and then melted by heat to be fixed thereon. In fixing the toner image, a large amount of electric power is needed for heating and melting the toner. Thus, from the viewpoint of energy saving, low-temperature fixability is one important feature of toner to be taken into consideration.

In the field of graphic arts, in recent years, embossed sheet that is a thick recording medium having surface irregularity is widely used. There has been a problem, however, in fixing a toner image on the embossed sheet that an adhesion force between the toner and the embossed sheet becomes insufficient at concave portions, because heat and pressure are less likely to transmit to the concave portions from a fixing belt.

SUMMARY

In accordance with some embodiments of the present invention, an image forming method is provided. The method includes the steps of forming an electrostatic latent image on a photoconductor; developing the electrostatic latent image into a toner image with a toner; transferring the toner image onto a recording medium having a smoothness of 20 s or less; and fixing the toner image on the recording medium. The toner exhibits an adhesion force of 100 gf or more, where the adhesion force is the maximum value of a pull force between a layer of the toner and standard paper determined by a tacking test with a probe temperature of 140° C.

In accordance with some embodiments of the present invention, a toner is provided. The toner includes a non-linear amorphous polyester resin A and a linear amorphous polyester resin B. The toner exhibits an adhesion force of 100 gf or more, where the adhesion force is the maximum value of a pull force between a layer of the toner and standard paper determined by a tacking test with a probe temperature of 140° C. THF-insoluble in the toner has a glass transition temperature, measured in a second heating of differential scanning calorimetry, in the range of −40° C. to 30° C. The THF-insoluble satisfies the following inequations:

$$1\times10^5\ (\mathrm{Pa}) \leq G'(100) \leq 1\times10^7\ (\mathrm{Pa})$$

$$G'(40)/G'(100) \leq 3.50\times10$$

wherein G'(40) and G'(100) represent storage elastic modulus of the THF-insoluble at 40° C. and 100° C., respectively.

In accordance with some embodiments of the present invention, an image forming apparatus is provided. The image forming apparatus includes: a photoconductor; an electrostatic latent image forming device to form an electrostatic latent image on the photoconductor; a developing device to develop the electrostatic latent image into a toner image; a transfer device to transfer the toner image onto a recoding medium; and a fixing device to fix the toner image on the recording medium. The fixing device includes an elastic layer having an average thickness t1 in the range of 300 to 500 μm and a release layer having an average thickness t2 of 10 μm or less. The fixing belt has a Martens hardness of 1.0 N/mm$^2$ or less. The fixing device has a nip portion having a surface pressure of 2.0 kg/cm$^2$ or more.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
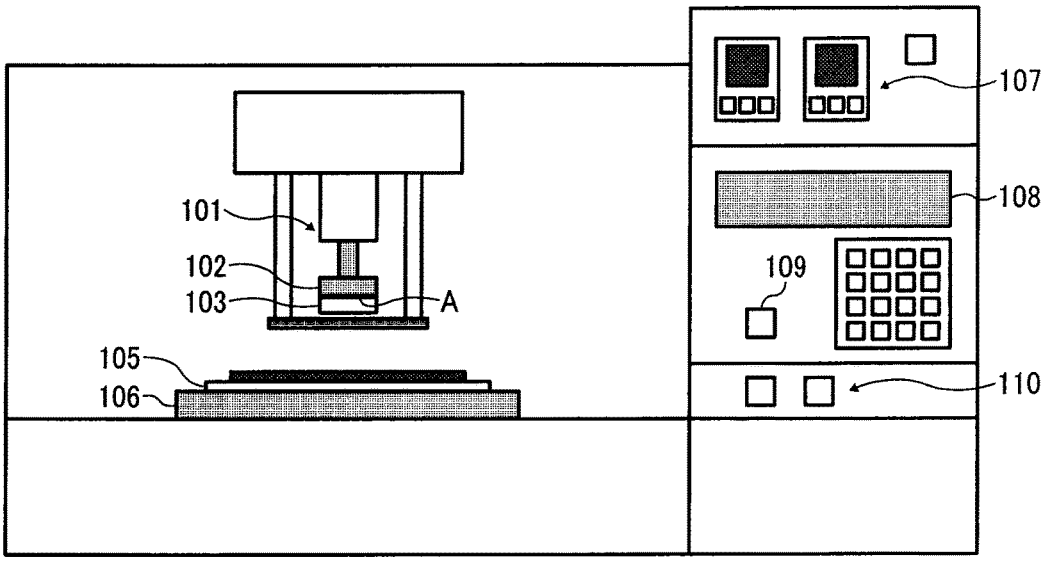
FIG. 1 is a schematic view of a device for measuring an adhesion force between a toner layer and a standard paper.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

One object of the present invention is to provide an image forming method capable of achieving reliable fixation of toner on embossed sheet that is a thick recording medium having surface irregularity with sufficient adhesion force even at low temperatures.

In accordance with some embodiments of the present invention, an image forming method capable of achieving reliable fixation of toner on embossed sheet that is a thick recording medium having surface irregularity with sufficient adhesion force even at low temperatures can be obtained.

In accordance with some embodiment of the present invention, the image forming method includes the processes of: forming an electrostatic latent image on a photoconductor; developing the electrostatic latent image into a toner image with a toner; transferring the toner image onto a recording medium having a smoothness of 20 s or less; and fixing the toner image on the recording medium. The toner exhibits an adhesion force of 100 gf or more, where the adhesion force is the maximum value of a pull force between a layer of the toner and standard paper determined by a tacking test with a probe temperature of 140° C.

The image forming apparatus may further include a cleaning process, a neutralization process, a recycle process, and a control process, if needed.

In accordance with some embodiment of the present invention, the image forming apparatus includes at least a photoconductor, an electrostatic latent image forming device, a developing device, a transfer device, and a fixing device. The image forming apparatus may further include a cleaner, a neutralizer, a recycler, and a controller, if needed.

The image forming method is preferably performed by the image forming apparatus. The electrostatic latent image forming process can be performed by the electrostatic latent image forming device. The developing process can be performed by the developing device.

The transfer process can be performed by the transfer device. The fixing process can be performed by the fixing device. The other processes can be performed by the other corresponding devices.

Toner

In accordance with some embodiments of the present invention, the toner exhibits an adhesion force of 100 gf or more. Here, the adhesion force is defined as the maximum value of pull force between a layer of the toner and standard paper determined by a tacking test with a probe temperature of 140° C.

Such a toner exhibits great fixability even on embossed sheets having a large degree of surface irregularity while providing low-temperature fixability and hot offset resistance.

The toner includes a binder resin. The binder resin preferably includes an amorphous resin. More preferably, the binder resin further includes a crystalline resin.

The crystalline resin is defined as a resin having a crystalline polymer segment and a melting point. The amorphous resin is defined as a resin having no crystalline polymer segment.

The amorphous resin preferably includes a non-linear amorphous polyester resin and a linear amorphous polyester resin. The non-linear amorphous polyester resin is generally insoluble in tetrahydrofuran (hereinafter "THF"). The linear amorphous polyester resin is generally soluble in THF.

One approach for improving low-temperature fixability involves reducing the glass transition temperature or molecular weight of the amorphous polyester resin so that the amorphous polyester resin and the crystalline polyester resin become eutectic. However, merely reducing the glass transition temperature or molecular weight of the amorphous polyester resin to reduce melt viscosity results in deterioration of the toner in heat-resistant storage stability and hot offset resistance.

The non-linear amorphous polyester resin has a very low glass transition temperature and is deformable at low temperatures. The non-linear amorphous polyester resin deforms upon application of heat and pressure at the time of fixing and becomes adhesive to a recording material, such as paper, at low temperatures. The non-linear amorphous polyester resin has a branched structure in its molecular skeleton because its reactive precursor is non-linear. The molecular chain of the non-linear amorphous polyester resin takes a three-dimensional network structure, exhibiting rubber-like property of being deformable but not flowable at low temperatures. Accordingly, the toner can maintain heat-resistant storage stability and hot offset resistance. In the case where the non-linear amorphous polyester resin has urethane or urea bond having high cohesive energy, the urethane or urea bond behaves as a pseudo cross-linking point that enhances the rubber-like property. As a result, the toner is further improved in terms of heat-resistant storage stability and hot offset resistance.

Such a toner has a glass transition temperature which falls within an ultralow temperature range. On the other hand, the combination use of the non-linear amorphous polyester resin having high melt viscosity and low flowability, the linear amorphous polyester resin, and the crystalline polyester resin makes it possible to maintain heat-resistant storage stability and hot offset resistance even when the glass transition temperature of the toner is low. Because the glass transition temperature is low, such a toner exhibits excellent low-temperature fixability.

The toner in accordance with some embodiments of the present invention includes the non-linear amorphous polyester resin at a constant rate, and the glass transition temperature of the toner is lower than that of the linear amorphous polyester resin. Such a toner is meltable at low temperatures and maintains rubber-like property, thereby enhancing its adhesion force to paper fiber.

Amorphous Polyester Resin

The amorphous polyester resin preferably includes a non-linear amorphous polyester resin A and a linear amorphous polyester resin B.

Non-Linear Amorphous Polyester Resin A

The non-linear amorphous polyester resin A contains THF-insoluble. The non-linear amorphous polyester resin A is not limited to any particular material, but is preferably obtained by a reaction of a non-linear reactive precursor with a curing agent.

Non-Linear Reactive Precursor

Specific examples of the non-linear reactive precursor include, but are not limited to, a polyester prepolymer having a group reactive with the curing agent.

Specific examples of the group reactive with the curing agent include, but are not limited to, a group reactive with an active hydrogen group. Specific examples of the group reactive with an active hydrogen group include, but are not limited to, isocyanate group, epoxy group, carboxyl group, and acid chloride group. Among these groups, isocyanate group is preferable because it is capable of introducing urethane or urea bond into the non-linear amorphous polyester resin A.

Here, "non-liner" refers to possession of a branched structure given by an alcohol having 3 or more valences and/or a carboxylic acid having 3 or more valences.

Specific examples of the prepolymer include, but are not limited to, a polyester resin having isocyanate group.

Polyester Resin Having Isocyanate Group

Specific examples of the polyester resin having isocyanate group include, but are not limited to, a reaction product of a polyester resin having an active hydrogen group with a polyisocyanate.

The polyester resin having an active hydrogen group can be obtained by a polycondensation of a diol, a dicarboxylic acid, and at least one of an alcohol having 3 or more valences and a carboxylic acid having 3 or more valences. The alcohol having 3 or more valences and the carboxylic acid having 3 or more valences can give a branched structure to the polyester resin having isocyanate group.

Diol

Specific examples of the diol include, but are not limited to, aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; diols having an oxyalkylene group such as diethylene glycol, triethylene glycol, dipropylene glycol, polyethylene glycol, polypropylene propylene glycol, and polytetramethylene glycol; alicyclic diols such as 1,4-cyclohexanedimethanol and hydrogenated bisphenol A; alkylene oxide (e.g., ethylene oxide, propylene oxide, butylene oxide) adducts of alicyclic diols; bisphenols such as bisphenol A, bisphenol F, and bisphenol S; and alkylene oxide (e.g., ethylene oxide, propylene oxide, butylene oxide) adducts of bisphenols. Among these diols, aliphatic diols having 4 to 12 carbon atoms are preferable.

Two or more of these diols can be used in combination.

Dicarboxylic Acid

Specific examples of the dicarboxylic acid include, but are not limited to, aliphatic dicarboxylic acids having 4 to 20 carbon atoms (e.g., succinic acid, adipic acid, sebacic acid, dodecanedioic acid, maleic acid, fumaric acid), aromatic dicarboxylic acids having 8 to 20 carbon atoms (e.g., phthalic acid, isophthalic acid, terephthalic acid, naphthalenedicarboxylic acid), and combinations thereof. Among these dicarboxylic acids, aliphatic dicarboxylic acids having 4 to 12 carbon atoms are preferable.

The dicarboxylic acid can be replaced with an anhydride, a lower alkyl ester having 1 to 3 carbon atoms, or a halide thereof.

Alcohol Having 3 or More Valences

Specific examples of the alcohol having 3 or more valences include, but are not limited to, aliphatic alcohols having 3 or more valences, polyphenols having 3 or more valences, and alkylene oxide adducts of polyphenols having 3 or more valences.

Specific examples of the aliphatic alcohols having 3 or more valences include, but are not limited to, glycerin, trimethylolethane, trimethylolpropane, pentaerythritol, and sorbitol.

Specific examples of the polyphenols having 3 or more valences include, but are not limited to, trisphenol PA, phenol novolac, and cresol novolac.

Specific examples of the alkylene oxide adducts of polyphenols having 3 or more valences include, but are not limited to, ethylene oxide adducts, propylene oxide adducts, and butylene oxide adducts of polyphenols having 3 or more valences.

Carboxylic Acid Having 3 or More Valences

Specific examples of the carboxylic acid having 3 or more valences include, but are not limited to, aromatic carboxylic acids having 3 or more valences. The carboxylic acid having 3 or more valences can be replaced with an anhydride, a lower alkyl ester having 1 to 3 carbon atoms, or a halide thereof.

Specific examples of the aromatic carboxylic acids having 3 or more valences preferably include aromatic carboxylic acids having 3 or more valences and 9 to 20 carbon atoms. Specific examples of the aromatic carboxylic acids having 3 or more valences and 9 to 20 carbon atoms include, but are not limited to, trimellitic acid and pyromellitic acid.

Polyisocyanate

Specific examples of the polyisocyanate include, but are not limited to, diisocyanates and isocyanates having 3 or more valences.

Specific examples of the diisocyanates include, but are not limited to, aliphatic diisocyanates, alicyclic diisocyanates, aromatic diisocyanates, aromatic aliphatic diisocyanates, and an isocyanurates.

Specific examples of the aliphatic diisocyanates include, but are not limited to, tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

Specific examples of the alicyclic diisocyanates include, but are not limited to, isophorone diisocyanate and cyclohexylmethane diisocyanate.

Specific examples of the aromatic diisocyanates include, but are not limited to, tolylene diisocyanate, diisocyanato diphenylmethane, 1,5-naphthylene diisocyanate, 4,4'-diisocyanato diphenyl, 4,4'-diisocyanato-3,3'-dimethyldiphenyl, 4,4'-diisocyanato-3-methyldiphenylmethane, and 4,4'-diisocyanato-diphenyl ether.

Specific examples of the aromatic aliphatic diisocyanates include, but are not limited to, $\alpha,\alpha,\alpha',\alpha'$-tetramethylxylylene diisocyanate.

Specific examples of the isocyanurates include, but are not limited to, tris(isocyanatoalkyl) isocyanurate and tris (isocyanatocycloalkyl) isocyanurate.

The polyisocyanate can be replaced with a blocked product thereof, the isocyanate group of which is blocked with a phenol derivative, oxime, or caprolactam.

Two or more of these polyisocyanates can be used in combination.

Curing Agent

The curing agent is not limited to any particular material so long as it is reactive with the non-linear reactive precursor to produce the non-linear amorphous polyester resin A. Specific examples of the curing agent include, but are not limited to, a compound having an active hydrogen group.

Compound Having Active Hydrogen Group

Specific examples of the active hydrogen group in the compound include, but are not limited to, hydroxyl group (e.g., alcoholic hydroxyl group, phenolic hydroxyl group), amino group, carboxyl group, and mercapto group. Two or more of these groups can be included in the compound in combination.

In particular, a compound having amino group is preferable because the amino group is capable of forming urea bond.

Specific examples of the compound having amino group include, but are not limited to, a diamine, an amine having 3 or more valences, an amino alcohol, an amino mercaptan, an amino acid, and a blocked amine the amino group of which is blocked. Two or more of these compounds can be used in combination.

Among these compounds, a diamine alone and a mixture of a diamine with a small amount of an amine having 3 or more valences are preferable.

Specific examples of the diamine include, but are not limited to, an aromatic diamine, an alicyclic diamine, and an aliphatic diamine. Specific examples of the aromatic diamine include, but are not limited to, phenylenediamine, diethyltoluenediamine, and 4,4'-diaminodiphenylmethane. Specific examples of the alicyclic diamine include, but are not limited to, 4,4'-diamino-3,3'-dimethyldicyclohexylmethane, diaminocyclohexane, and isophoronediamine. Specific examples of the aliphatic diamine include, but are not limited to, ethylenediamine, tetramethylenediamine, and hexamethylenediamine.

Specific examples of the amine having 3 or more valences include, but are not limited to, diethylenetriamine and triethylenetetramine.

Specific examples of the amino alcohol include, but are not limited to, ethanolamine and hydroxyethylaniline.

Specific examples of the amino mercaptan include, but are not limited to, aminoethyl mercaptan and aminopropyl mercaptan.

Specific examples of the amino acid include, but are not limited to, aminopropionic acid and aminocaproic acid.

Specific examples of the blocked amine include, but are not limited to, ketimine compounds obtained by blocking the amino group in amines with ketones (e.g., acetone, methyl ethyl ketone, methyl isobutyl ketone), and oxazoline compounds.

The non-linear amorphous polyester resin A preferably satisfies at least one of the following conditions (a) to (c) to make it easier to lower its glass transition temperature (Tg) and become deformable at low temperatures.

(a) The resin A includes diol components which include 50% by weight or more of an aliphatic diol having 4 to 12 carbon atoms.

(b) The total alcohol components include 50% by weight or more of an aliphatic diol having 4 to 12 carbon atoms.

(c) The resin A includes dicarboxylic acid components which include 50% by weight or more of an aliphatic dicarboxylic acid having 4 to 12 carbon atoms.

The non-linear amorphous polyester resin A preferably has a glass transition temperature (Tg) in the range of −60° C. to 0° C., more preferably in the range of −40° C. to −20° C. When Tg is less than −60° C., toner flowage is insuppressible at low temperatures, resulting in deterioration in heat-resistant storage stability and filming resistance. When Tg is in excess of 0° C., toner deformability upon application of heat and pressure at the time of fixing is insufficient, resulting in deterioration in low-temperature fixability.

The non-linear amorphous polyester resin A preferably has a weight average molecular weight in the range of 20,000 to 100,000. When the weight average molecular weight is less than 20,000, the toner may be flowable at low temperatures, resulting in deterioration in heat-resistant storage stability. Additionally, at the time of melting, the toner may reduce its viscosity, resulting in deterioration in hot offset resistance. When the weight average molecular weight is in excess of 100,000, low-temperature fixability may deteriorate.

Weight average molecular weight is a polystyrene-conversion molecular weight obtained by gel permeation chromatography (GPC).

The molecular structure of the non-linear amorphous polyester resin A can be determined by means of solution-state or solid-state NMR, X-ray diffractometry, GC/MS, LC/MS, IR, or the like. For example, an infrared absorption spectrum having no absorption based on δCH (out-of-plane bending vibration) at 965±10 $cm^{-1}$ and 990±10 $cm^{-1}$ is identified as the amorphous polyester resin.

The content of the non-linear amorphous polyester resin A in the toner is preferably from 5 to 25 parts by weight, more preferably from 10 to 20 parts by weight, based on 100 parts by weight of the toner. When the content is less than 5 parts by weight, low-temperature fixability and hot offset resistance may deteriorate. When the content is in excess of 25 parts by weight, heat-resistant storage stability may deteriorate and image gloss may decrease.

Linear Amorphous Polyester Resin B

Preferably, the linear amorphous polyester resin B is a linear unmodified polyester resin.

The unmodified polyester resin is defined as a polyester resin which is not modified with a polyisocyanate or the like.

The linear amorphous polyester resin is obtainable by a polycondensation of a diol with a dicarboxylic acid.

Specific examples of the diol include, but are not limited to, C2-C3 alkylene oxide adducts of bisphenol A with an average adduct molar number of 1 to 10 (e.g., polyoxypropylene(2.2)-2,2-bis(4-hydroxyphenyl)propane, polyoxyethylene(2.2)-2,2-bis(4-hydroxyphenyl)propane), ethylene glycol, propylene glycol, hydrogenated bisphenol A, and C2-C3 alkylene oxide adducts of hydrogenated bisphenol A with an average adduct molar number of 1 to 10.

Two or more of these compounds can be used in combination.

Specific examples of the dicarboxylic acid include, but are not limited to, adipic acid, phthalic acid, isophthalic acid, terephthalic acid, fumaric acid, maleic acid, and succinic acid substituted with an alkyl group having 1 to 20 carbon atoms or an alkenyl group having 2 to 20 carbon atoms, such as dodecenyl succinic acid and octyl succinic acid.

Two or more of these compounds can be used in combination.

The linear amorphous polyester resin B may have on its resin chain terminal a structural unit derived from a carboxylic acid having 3 or more valences or a structural unit derived from an alcohol having 3 or more valences, for the purpose of adjusting acid value and hydroxyl value.

Specific examples of the carboxylic acid having 3 or more valences include, but are not limited to, trimellitic acid and pyromellitic acid.

Specific examples of the alcohol having 3 or more valences include, but are not limited to, glycerin, pentaerythritol, and trimethylolpropane.

The linear amorphous polyester resin B preferably has a weight average molecular weight (Mw) in the range of 3,000 to 10,000, more preferably in the range of 4,000 to 7,000. The linear amorphous polyester resin B preferably has a number average molecular weight (Mn) in the range of 1,000 to 4,000, more preferably in the range of 1,500 to 3,000. The ratio (Mw/Mn) of the weight average molecular weight (Mw) to the number average molecular weight (Mn) with respect to the linear amorphous polyester resin B is preferably from 1.0 to 4.0, more preferably from 1.0 to 3.5. When the weight average molecular weight of the linear amorphous polyester resin B is too low, the toner may deteriorate in heat-resistant storage stability or resistance to stirring stress in a developing device. When the weight average molecular weight is too high, the toner may exhibit too high a viscoelasticity at the time of melting, resulting in deterioration in low-temperature fixability.

The weight average molecular weight and number average molecular weight of the linear amorphous polyester resin B are polystyrene-conversion molecular weights measured by GPC.

The linear amorphous polyester resin B preferably has an acid value in the range of 1 to 50 mgKOH/g, more preferably in the range of 5 to 30 mgKOH/g. When the acid value is equal to or greater than 1 mgKOH/g, the toner is likely to be negatively chargeable. In this case, the affinity of the toner for paper is improved, and therefore low-temperature fixability of the toner is improved. When the acid value is in excess of 50 mgKOH/g, charge stability, particularly charge stability in terms of environmental fluctuation, may deteriorate.

The linear amorphous polyester resin B preferably has a hydroxyl value of 5 mgKOH/g or more.

The linear amorphous polyester resin B preferably has a glass transition temperature (Tg) in the range of 40° C. to 80° C., more preferably in the range of 50° C. to 70° C. When the glass transition temperature is less than 40° C., the toner may deteriorate in heat-resistant storage stability, resistance to stirring stress in a developing device, or filming resistance. When the glass transition temperature is in excess of 80° C., toner deformability upon application of heat and pressure at the time of fixing is insufficient, resulting in deterioration in low-temperature fixability.

The molecular structure of the linear amorphous polyester resin B can be determined by means of solution-state or solid-state NMR, X-ray diffractometry, GC/MS, LC/MS, IR, or the like. For example, an infrared absorption spectrum having no absorption based on δCH (out-of-plane bending vibration) at 965±10 $cm^{-1}$ and 990±10 $cm^{-1}$ is identified as the amorphous polyester resin.

The content of the linear amorphous polyester resin B in the toner is preferably from 50 to 90 parts by weight, more preferably from 60 to 80 parts by weight, based on 100 parts by weight of the toner. When the content is less than 50 parts by weight, the dispersibility of colorants and release agents in the toner may deteriorate, thereby causing abnormal image having fog or disturbance. When the content is in excess of 90 parts by weight, it means that the contents of a crystalline polyester resin C (to be described later) and the non-linear amorphous polyester resin A are relatively small, resulting in deterioration in low-temperature fixability.

Crystalline Polyester Resin C

Preferably, the crystalline resin is a crystalline polyester resin C having high crystallinity. The crystalline polyester resin C has a thermal fusion property of exhibiting rapid viscosity reduction at around the fixing onset temperature owing to the high crystallinity. By combination use of the crystalline polyester resin C with the linear amorphous polyester resin B, the toner maintains good heat-resistant storage stability at temperatures lower than the melting onset temperature owing to the crystallinity, and rapidly reduces its viscosity at the melting onset temperature owing to the melting of the crystalline polyester resin C. The crystalline polyester resin C in a melted state becomes compatible with the linear amorphous polyester resin B, and makes the toner fixed on a recording medium. Such a toner achieves a good combination of heat-resistant storage stability and low-temperature fixability. In addition, the toner has an appropriate fixable temperature range (i.e., the difference between the lower-limit and upper-limit fixable temperatures).

The crystalline polyester resin C is obtainable by a polycondensation of a polyol with a polycarboxylic acid. Accordingly, the crystalline polyester resin C includes no crystalline modified polyester resin which is obtained by cross-linking and/or elongation of a crystalline polyester prepolymer having an isocyanate group.

Polyol

Specific examples of the polyol include, but are not limited to, a diol and an alcohol having 3 or more valences.

Specific examples of the diol include, but are not limited to, saturated aliphatic diols. Specific examples of the saturated aliphatic diols include, but are not limited to, straight-chain saturated aliphatic diols and branched saturated aliphatic diols. Among these diols, straight-chain saturated aliphatic diols are preferable, and straight-chain saturated aliphatic diols having 2 to 12 carbon atoms are more preferable. Branched saturated aliphatic diol may reduce the crystallinity, as well as the melting point, of the crystalline polyester resin C. Saturated aliphatic diols having carbon atoms in excess of 12 are difficult to obtain.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these diols, ethylene glycol, 1,4-butanediol, 1,6-hexanediol, 1,8-octanediol, 1,10-decanediol, and 1,12-dodecanediol are preferable because they can give high crystallinity and sharply-melting property to the crystalline polyester resin C.

Specific examples of the alcohol having 3 or more valences include, but are not limited to, glycerin, trimethylolethane, trimethylolpropane, and pentaerythritol.

Two or more of these compounds can be used in combination.

Polycarboxylic Acid

Specific examples of the polycarboxylic acid include, but are not limited to, a dicarboxylic acid and a carboxylic acid having 3 or more valences.

Specific examples of the dicarboxylic acid include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids, including dibasic acids, such as phthalic acid, isophthalic acid, terephthalic acid, naphthalene-2,6-dicarboxylic acid, malonic acid, and mesaconic acid.

Specific examples of the carboxylic acid having 3 or more valences include, but are not limited to, 1,2,4-benzenetricarboxylic acid, 1,2,5-benzenetricarboxylic acid, and 1,2,4-naphthalenetricarboxylic acid.

The polycarboxylic acid can be replaced with an anhydride or a lower alkyl ester having 1 to 3 carbon atoms thereof.

In addition, as the polycarboxylic acid, a dicarboxylic acid having sulfonic acid group can also be used in combination with the saturated aliphatic dicarboxylic acid or aromatic dicarboxylic acid.

Moreover, a dicarboxylic acid having a double bond can also be used in combination with the saturated aliphatic dicarboxylic acid or aromatic dicarboxylic acid.

Two or more of these compounds can be used in combination.

The crystalline polyester resin C preferably has a structural unit derived from a saturated aliphatic dicarboxylic acid having 4 to 12 carbon atoms and another structural unit derived from a saturated aliphatic diol having 2 to 12 carbon atoms. Such a crystalline polyester resin has high crystallinity and sharply-melting property, which leads to an improvement in low-temperature fixability.

The crystalline polyester resin C preferably has a melting point in the range of 60° C. to 80° C. When the melting point is less than 60° C., the crystalline polyester resin C is likely to melt at low temperatures, resulting in deterioration of the toner in heat-resistant storage stability. When the melting point is in excess of 80° C., melting of the crystalline polyester resin C upon application of heat at the time of fixing is insufficient, causing deterioration in low-temperature fixability.

The crystalline polyester resin C preferably has a weight average molecular weight (Mw) in the range of 3,000 to 30,000, more preferably in the range of 5,000 to 15,000. The crystalline polyester resin C preferably has a number average molecular weight (Mn) in the range of 1,000 to 10,000, more preferably in the range of 2,000 to 10,000. The ratio (Mw/Mn) of the weight average molecular weight (Mw) to the number average molecular weight (Mn) with respect to the crystalline polyester resin C is preferably from 1.0 to 10, more preferably from 1.0 to 5.0. The crystalline polyester resin C with a sharp molecular weight distribution and a low molecular weight achieves excellent low-temperature fixability. The crystalline polyester resin C with a large content of low-molecular-weight components may cause deterioration in heat-resistant storage stability.

The weight average molecular weight and number average molecular weight of the crystalline polyester resin C are polystyrene-conversion molecular weights of o-dichlorobenzene-soluble in the crystalline polyester resin C measured by GPC.

The crystalline polyester resin C preferably has an acid value of 5 mgKOH/g or more, more preferably 10 mgKOH/g or more, in view of affinity of the resin for paper, for achieving a desired degree of low-temperature fixability. On the other hand, the crystalline polyester resin C preferably has an acid value of 45 mgKOH/g or less, for improving hot offset resistance.

The crystalline polyester resin C preferably has a hydroxyl value in the range of 0 to 50 mgKOH/g, more preferably in the range of 5 to 50 mgKOH/g, for achieving a desired degree of low-temperature fixability and excellent charge property.

The molecular structure of the crystalline polyester resin C can be determined by means of solution-state or solid-state NMR, X-ray diffractometry, GC/MS, LC/MS, IR, or the like. For example, an infrared absorption spectrum having absorption based on δCH (out-of-plane bending vibration) at 965±10 $cm^{-1}$ or 990±10 $cm^{-1}$ is identified as the crystalline polyester resin C.

The content of the crystalline polyester resin C in the toner is preferably from 3 to 20 parts by weight, more preferably from 5 to 15 parts by weight, based on 100 parts by weight of the toner. When the content is less than 3 parts by weight, sharply-melting property of the crystalline polyester resin C is insufficient, resulting in deterioration in low-temperature fixability. When the content is in excess of 20 parts by weight, heat-resistant storage stability may deteriorate and image fog may be caused.

Other Components

The toner may further include a release agent, a colorant, a charge controlling agent, a flowability improver, a cleanability improver, a magnetic material, or the like, if needed.

Release Agent

Specific examples of the release agent include, but are not limited to, a wax.

Specific examples of the wax include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, microcrystalline wax, petrolatum wax).

Specific examples of the wax further include, but are not limited to, synthetic hydrocarbon waxes (e.g., Fischer-Tropsch wax, polyethylene, polypropylene) and synthetic waxes (e.g., ester wax, ketone wax, ether wax).

Specific examples of the wax further include, but are not limited to, fatty acid amides (e.g., 12-hydroxystearic acid amide, stearic acid amide, phthalic anhydride imide, and chlorinated hydrocarbon.

Among these waxes, hydrocarbon waxes such as paraffin wax, microcrystalline wax, Fischer-Tropsch wax, polyethylene wax, and polypropylene wax are preferable.

The release agent preferably has a melting point in the range of 60° C. to 80° C. When the melting point is less than 60° C., the toner is likely to melt at low temperatures, resulting in deterioration in heat-resistant storage stability. When the melting point is in excess of 80° C., even when the binder resin is melted within the fixable temperature range, the release agent melts insufficiently, causing offset and defective image.

The content of the release agent in the toner is preferably from 2 to 10 parts by weight, more preferably from 3 to 8 parts by weight, based on 100 parts by weight of the toner. When the content is less than 2 parts by weight, hot offset resistance and low-temperature fixability may deteriorate. When the content is in excess of 10 parts by weight, heat-resistant storage stability may deteriorate and image fog may occur.

Colorant

Specific examples of the colorant include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

The content of the colorant in the toner is preferably from 1 to 15 parts by weight, more preferably from 3 to 10 parts by weight, based on 100 parts by weight of the toner.

The colorant can be combined with a resin to be used as a master batch.

The master batch can be obtained by mixing and kneading a resin and a colorant while applying a high shearing force. To increase the interaction between the colorant and the resin, an organic solvent can be used. More specifically, the maser batch can be obtained by a method called flushing in which an aqueous paste of the colorant is mixed and kneaded with the resin and the organic solvent, so that the colorant is transferred to the resin side, followed by removal of the organic solvent and moisture. The flushing method is preferred because the wet cake of the colorant can be used it is without being dried. When performing the mixing or kneading, a high shearing force dispersing device such as a three roll mill can be preferably used.

Charge Controlling Agent

Specific examples of the charge controlling agent include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, metal salts of salicylic acid derivatives, copper phthalocyanine, perylene, quinacridone, and azo pigments.

Specific examples of usable commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; and LRA-901, and LR-147 (boron complex), which are manufactured by Japan Carlit Co., Ltd.

The content of the charge controlling agent in the toner is preferably from 0.1 to 10 parts by weight, more preferably from 0.2 to 5 parts by weight, based on 100 parts by weight of the toner. When the content of the charge controlling agent is in excess of 10 parts by weight, the toner is excessively chargeable. The effect of the charge controlling agent is reduced, but an electrostatic attractive force of the toner to a developing roller is increased. The developer may deteriorate in flowability, and the resulting image density may decrease.

The charge controlling agent can be dispersed in an organic solvent after becoming a master batch by being melted and kneaded with the resin, or directly. Alternatively, the charge controlling agent can be fixed on the surfaces of mother toner particles.

Flowability Improver

Specific examples of the flowability improver include, but are not limited to, inorganic particles such as silica particle, titania particle, and alumina particle.

The flowability improver is preferably hydrophobized with a surface treatment agent.

Specific examples of the surface treatment agent include, but are not limited to, silane coupling agents, silylation agents, silane coupling agents having a fluorinated alkyl group, organic titanate coupling agents, aluminum coupling agents, silicone oils, and modified silicone oils.

The content of the flowability improver in the toner is preferably from 0.1 to 5 parts by weight, more preferably from 0.3 to 3 parts by weight, based on 100 parts by weight of the toner.

The flowability improver preferably has an average primary particle diameter of 100 nm or less, more preferably from 3 to 70 nm. A flowability improver with the average primary particle diameter of less than 3 nm is likely to be embedded in mother toner particles and unlikely to exert its effect. A flowability improver with the average particle diameter in excess of 70 nm may make nonuniform scratches on the surface of a photoconductor.

Cleanability Improver

Specific examples of the cleanability improver include, but are not limited to, metal salts of fatty acids (e.g., zinc stearate, calcium stearate) and fine particles of polymers prepared by soap-free emulsion polymerization (e.g., polymethyl methacrylate, polystyrene). Preferably, the fine particles of polymers have a volume average particle diameter in the range of 0.01 to 1 μm.

Magnetic Material

Specific examples of the magnetic material include, but are not limited to, iron powder, magnetite, and ferrite. Among these magnetic materials, those having a whitish color are preferable.

Toner Properties

In accordance with some embodiments of the present invention, the toner exhibits an adhesion force of 100 gf or more, where the adhesion force is defined as the maximum value of a pull force between a layer of the toner and standard paper determined by a tacking test with a probe temperature of 140° C.

Preferably, the adhesion force is 120 gf or more. More preferably, the adhesion force is 150 gf or more.

Additionally, it is preferable that the adhesion force is 300 gf or less.

Here, the standard paper is categorized as plain paper without embossing finish or surface coating, having a basis weight of from 75 to 85 g/m$^2$ and a smoothness of from 100 to 150 s. Specific examples of such paper include, but are not limited to, a commercially-available paper TYPE 6000 <70W> from Ricoh Co., Ltd.

Measurement of Adhesion Force

An adhesion force between a toner layer and a standard paper is measured in the following manner. FIG. 1 is a schematic view of a device for measuring an adhesion force between a toner layer and a standard paper. This measurement device represents a tacking tester TAC-II available from Rhesca Corporation.

1) A standard paper P 105 having an unfixed toner thereon is set on a stage 106. The standard paper P 105 is a commercially-available paper TYPE 6000 <70W> from Ricoh Co., Ltd. The toner deposition amount is 0.85 mg/cm$^2$.

2) A probe 102 having a diameter of 10 mm is set to a load sensor 101.

3) A power switch 109 is pressed to display main menu.

4) On a setting display panel 108, "[1] Tackiness Test" is selected. As the control method, "[1] Constant Load" is selected.

5) In "PARAMETER SETTING", parameters are set as follows.

Immersion Speed: 120 mm/min
Test Speed: 600 mm/min
Preload: 1,000 gf
Press Time: 0.1 sec
Distance: 5 mm 6) One of temperature controllers 107 on the probe 102 side is set to 140° C. The other temperature controller 107 on the stage side is set to 0° C.

7) A thermocouple is brought into contact with a surface A of the probe 102 from outside to check the temperature. When the temperature is lower than 140° C., the temperature settings of the temperature controllers 107 are turned up. When the temperature is higher than 140° C., the temperature settings of the temperature controllers 107 are turned down.

8) After a lapse of 5 minutes or longer since the temperature has reached 140° C., an elastic double-faced tape 103 is attached to the surface A of the probe 102. The elastic double-faced tape 103 is a 3M™ VHB™ tape having a thickness of 1.1 mm (from Sumitomo 3M).

9) After a lapse of 5 minutes or longer, a measurement start switch 110 is pressed.

10) At the end of the measurement, measurement results are displayed on the setting display panel 108 and "Peak Load (go" is recorded.

The toner preferably has a glass transition temperature (Tg1st), measured in the first heating of differential scanning calorimetry, in the range of 30° C. to 50° C. When Tg1st is less than 30° C., heat-resistant storage stability may deteriorate, toner blocking may occur in a developing device, and/or toner filming may occur on a photoconductor. When Tg1st is in excess of 50° C., low-temperature fixability of the toner may deteriorate.

Conventional toners having a glass transition temperature at around 50° C. are likely to aggregate when transported during summer season or in the tropics or exposed to environmental temperature change during storage. Such toners will solidify in a toner bottle or adhere to an inside of a developing device. As a result, it is likely that toner clogging in the toner bottle causes defective supply of toner and toner adherence in the developing device causes abnormal image. Although having a glass transition temperature lower than that of the conventional toners, the toner in accordance with some embodiments of the present invention can maintain heat-resistant storage stability because of including the non-linear amorphous polyester having a low glass transition temperature.

The difference (Tg1st−Tg2nd) between Tg1st of the toner and a glass transition temperature (Tg2nd), measured in the second heating of differential scanning calorimetry, of the toner is preferably 10° C. or more. In this case, low-temperature fixability is improved. A difference (Tg1st−Tg2nd) of 10° C. or more means that the crystalline polyester resin, the non-linear amorphous polyester resin, and the linear amorphous polyester resin, which exist incompatible with each other before the first heating, become compatible with each other after the first heating. They do not necessarily achieve complete compatibilization. Preferably, the difference (Tg1st−Tg2nd) is 50° C. or less.

The toner preferably has a melting point in the range of 60° C. to 80° C.

THF-insoluble in the toner preferably has a glass transition temperature (Tg2nd), measured in the second heating of differential scanning calorimetry, in the range of −40° C. to 30° C.

When Tg2nd of the THF-insoluble is less than −40° C., heat-resistant storage stability may deteriorate. When Tg2nd of the THF-insoluble is in excess of 30° C., low-temperature fixability may deteriorate.

Tg2nd of the THF-insoluble in the toner greatly depends on Tg2nd of the non-linear amorphous polyester resin A. When Tg2nd of the non-linear amorphous polyester resin A is lower than that of the linear amorphous polyester resin B, the toner exhibits excellent low-temperature fixability. In the case where the non-linear amorphous polyester resin A has urethane or urea bond having high cohesive energy, the toner maintains heat-resistant storage stability more effectively and notably.

THF-soluble in the toner preferably satisfies the following inequations:

$$1\times10^5\ (\mathrm{Pa})\leq G'(100)\leq1\times10^7\ (\mathrm{Pa})$$

$$G'(40)/G'(100)\leq3.50\times10$$

wherein G'(40) and G'(100) represent storage elastic modulus of the THF-insoluble at 40° C. and 100° C., respectively.

In this case, compatibilization of the non-linear amorphous polyester resin A with the linear amorphous polyester resin B and the optionally-included crystalline polyester resin C is accelerated to improve low-temperature fixability.

More preferably, the following inequation is satisfied.

$$5\times10^5\ (\mathrm{Pa})\leq G'(100)\leq5\times10^6\ (\mathrm{Pa})$$

In this case, low-temperature fixability, heat-resistant storage stability, and hot offset resistance can be maintained.

In the case where the toner includes the crystalline polyester resin C, it is preferable that THF-soluble in the toner has a Tg2nd in the range of 20° C. to 35° C. In this case, the THF-soluble is composed of the linear amorphous polyester resin B and the crystalline polyester resin C. The crystalline polyester resin rapidly reduces its viscosity at around the fixing onset temperature owing to its crystallinity. By combination use of the crystalline polyester resin C with the linear amorphous polyester resin B, the toner maintains good heat-resistant storage stability at temperatures lower than the melting onset temperature owing to the crystalline polyester resin C. The toner rapidly reduces its viscosity at the melting onset temperature because the crystalline polyester resin C melts. The melted crystalline polyester resin C becomes compatible with the linear amorphous polyester resin B, and rapidly reduces its viscosity together to be fixed. Such a toner achieves a good combination of heat-resistant storage stability and low-temperature fixability. When Tg2nd of the THF-soluble is less than 20° C., the fixed image (printed matter) may deteriorate in blocking resistance. When Tg2nd of the THF-soluble is in excess of 35° C., low-temperature fixability or image gloss may be insufficient.

The content of the THF-insoluble in the toner is preferably from 20% to 35% by weight. When the content of the THF-insoluble is less than 20% by weight, the glass transition temperature of the toner will not decrease, causing deterioration in low-temperature fixability. When the content of the THF-insoluble is in excess of 35% by weight, the glass transition temperature of the toner will decrease excessively, causing deterioration in heat-resistant storage stability.

The toner preferably has a volume average particle diameter in the range of 3 to 7 μm. The ratio of the volume average particle diameter to the number average particle diameter of the toner is preferably equal to or less than 1.2. The toner preferably contains particles having a volume average particle diameter of 2 μm or less in an amount of 1% to 10% by number.

The volume average particle diameter and number average particle diameter of the toner can be measured with a particle size analyzer MULTISIZER III (from Beckman Coulter, Inc.).

Separation of THF-Soluble and THF-Insoluble

THF-insoluble and THF-soluble can be separated from the toner as follows.

The toner in an amount of 1 g is stirred in 100 mL of THF at 25° C. for 30 minutes. The resultant liquid is filtered with a membrane filter having an opening of 0.2 m. THF-insoluble is obtained by collecting the residue. THF-soluble is obtained by drying the filtrate.

Storage Elastic Modulus G'

Storage elastic modulus G' is measured with a dynamic viscoelasticity measurement device ARES Rheometer (from TA Instruments). A sample is pelletized into a pellet having a diameter of 8 mm and a thickness of 1 mm. The pellet is set between parallel plates having a diameter of 8 mm, stabilized at 40° C., and subjected to a measurement under a frequency of 1 Hz (6.28 rad/s) and deformation control mode with an amount of deformation of 0.1% while raising temperature to 200° C. at a rate of 2.0° C./min.

Glass Transition Temperatures

Tg1st and Tg2nd Melting point and glass transition temperature are measured with a differential scanning calorimeter Q-200 (from TA Instruments). First, a sample container is charged with about 5.0 mg of a sample, put on a holder unit, and set in an electric furnace. The sample is heated from −80° C. to 150° C. at a heating rate of 10° C./min in nitrogen atmosphere (i.e., the first heating). The sample is then cooled from 150° C. to −80° C. at a cooling rate of 10° C./min, and reheated to 150° C. at a heating rate of 10° C./min (i.e., the second heating).

A glass transition temperature Tg1st is determined by analyzing a DSC curve obtained in the first heating with an analysis program included in the Q-200 system.

A glass transition temperature Tg2nd is determined by analyzing a DSC curve obtained in the second heating with an analysis program included in the Q-200 system.

A melting point can be determined by analyzing the DSC curve obtained in the first heating with an analysis program included in the Q-200 system to detect a temperature where endothermic peak becomes maximum in the first heating. A melting point can be determined by analyzing the DSC curve obtained in the second heating with an analysis program included in the Q-200 system to detect a temperature where endothermic peak becomes maximum in the second heating.

Method of Manufacturing Toner

A method of manufacturing the toner preferably includes the processes of dissolving or dispersing toner materials including at least the binder resin including an amorphous polyester resin and a crystalline polyester resin in an organic solvent to prepare an oily phase, and dispersing the oily phase in an aqueous phase, but is not limited thereto.

The toner is preferably obtained by dispersing an oily phase containing the non-linear amorphous polyester resin A, linear amorphous polyester resin B, and crystalline polyester resin C, and optionally the release agent, colorant, and the like, in an aqueous phase.

Alternatively, the toner is preferably obtained by dispersing an oily phase containing the non-linear reactive precursor, linear amorphous polyester resin B, and crystalline polyester resin C, and optionally the curing agent, release agent, colorant, and the like, in an aqueous phase.

Specific methods of manufacturing the toner include, but are not limited to, dissolution suspension method.

One method of manufacturing the toner includes forming mother toner particles while elongating and/or cross-linking the non-linear reactive precursor with the curing agent to produce the non-linear amorphous polyester resin A. This method further includes the processes of preparation of an aqueous phase, preparation of an oily phase containing toner materials, emulsification or dispersion of the toner materials in an organic solvent, and removal of the organic solvent.

The resulting toner particles are washed, dried, and classified, and can be further mixed with an external additive.

Preparation of Aqueous Phase

An aqueous phase can be prepared by dispersing an organic resin particle in an aqueous medium.

The organic resin particle serves as a dispersion (emulsification) stabilizer for making the particle size distribution of the resulting toner sharp.

Specific examples of the organic resin include, but are not limited to, thermoplastic resins and thermosetting resins, such as vinyl resin, polyurethane resin, epoxy resin, polyester resin, polyamide resin, polyimide resin, silicon resin, phenol resin, melamine resin, urea resin, aniline resin, ionomer resin, and polycarbonate resin.

The content of the organic resin particle in the aqueous medium is preferably from 0.5 to 10 parts by weight based on 100 parts by weight of the aqueous medium.

Specific examples of the aqueous medium include, but are not limited to, water, a water-miscible solvent, and a mixture thereof. Two or more of these aqueous media can be used in combination. Among these aqueous media, water is preferable.

Specific examples of the water-miscible solvent include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone.

Preparation of Oily Phase

An oily phase can be prepared by dissolving or dispersing toner materials including at least the non-linear reactive precursor, linear amorphous polyester resin B, and crystalline polyester resin C, and optionally the curing agent, release agent, colorant, and the like, in an organic solvent.

As the organic solvent, an organic solvent having a boiling point less than 150° C. is preferable as it is easy to remove.

Specific examples of the organic solvent having a boiling point less than 150° C. include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these organic solvents can be used in combination.

Among these organic solvents, ethyl acetate, toluene, xylene, benzene, methylene chloride, 1,2-dichloroethane, chloroform, and carbon tetrachloride are preferable, and ethyl acetate is most preferable.

Emulsification and Dispersion

The oily phase containing the toner materials is dispersed in the aqueous phase to cause emulsification or dispersion of the toner materials. At the time of the emulsification or dispersion of the toner materials, the curing agent and the non-linear reactive precursor are subjected to an elongation and/or cross-linking reaction to produce the non-linear amorphous polyester resin A.

The non-linear amorphous polyester resin A can be produced by any one of the following methods (1) to (3).

(1) Emulsifying or dispersing an oily phase containing the non-linear reactive precursor and the curing agent in an aqueous medium, to cause an elongation and/or cross-linking reaction between the curing agent and the non-linear reactive precursor in the aqueous medium, thereby producing the non-linear amorphous polyester resin A.

(2) Emulsifying or dispersing an oily phase containing the non-linear reactive precursor in an aqueous medium to which the curing agent has been added, to cause an elongation and/or cross-linking reaction between the curing agent and the non-linear reactive precursor in the aqueous medium, thereby producing the non-linear amorphous polyester resin A.

(3) Emulsifying or dispersing an oily phase containing the non-linear reactive precursor in an aqueous medium and subsequently adding the curing agent to the aqueous medium, to cause an elongation and/or cross-linking reaction between the curing agent and the non-linear reactive precursor from the particle interface in the aqueous medium, thereby producing the non-linear amorphous polyester resin A.

In the case where the elongation and/or cross-linking reaction between the curing agent and the non-linear reactive precursor is caused from the particle interface, the non-linear amorphous polyester resin A is preferentially formed on the surface of the resulting mother toner particle forming a concentration gradient of the non-linear amorphous polyester resin A in the mother toner particle.

The reaction conditions (e.g., reaction time, reaction temperature) for producing the non-linear amorphous polyester resin A are determined according to the types of the curing agent and the non-linear reactive precursor in use.

The reaction time is preferably in the range of 10 minutes to 40 hours, more preferably in the range of 2 to 24 hours.

The reaction temperature is preferably in the range of 0° C. to 150° C., more preferably in the range of 40° C. to 98° C.

For forming a stable dispersion liquid of the non-linear reactive precursor, the oily phase prepared by dissolving or dispersing the toner materials in the organic solvent can be dispersed in the aqueous phase by means of shearing force.

Specific usable disperses for use in the dispersion include, but are not limited to, low-speed shearing disperser, high-speed shearing disperser, frictional disperser, high-pressure jet disperser, and ultrasonic disperser.

Among these dispersers, high-speed shearing disperser is preferable because it is capable of controlling dispersing elements (oil droplets) to have a particle diameter in the range of 2 to 20 μm.

In the case of using the high-speed shearing disperser, the rotation number, dispersing time, and dispersing temperature, and the like, may be varied depending on the purpose.

The rotation number is preferably in the range of 1,000 to 30,000 rpm, more preferably in the range of 5,000 to 20,000 rpm.

The dispersing time is preferably in the range of 0.1 to 5 minutes in the case of using a batch disperser.

The dispersing temperature is preferably in the range of 0° C. to 150° C., more preferably in the range of 40° C. to 98° C., under pressure. Generally, the higher the dispersing temperature, the easier the dispersing.

The amount of the aqueous phase used for emulsifying or dispersing the toner materials is preferably in the range of 50 to 2,000 parts by weight, more preferably in the range of 100 to 1,000 parts by weight, based on 100 parts by weight of the toner materials.

When the used amount of the aqueous medium is less than 50 parts by weight, the dispersed state of the toner materials may be too poor to obtain mother toner particles having a desired particle size. When the used amount of the aqueous medium is in excess of 2,000 parts by weight, the production cost may increase.

At the time the oily phase containing the toner materials are emulsified or dispersed, a dispersant is preferably used for stabilizing the dispersing elements (oil droplets) and obtaining particles having a desired shape and a sharp particle size distribution.

Specific examples of the dispersant include, but are not limited to, a surfactant, a poorly-water-soluble inorganic compound dispersant, and a polymeric protection colloid. Two or more of these dispersants can be used in combination. Among these dispersants, a surfactant is preferable.

Specific examples of the surfactant include, but are not limited to, anionic surfactants, cationic surfactants, nonionic surfactants, and ampholytic surfactants.

Specific examples of the anionic surfactants include, but are not limited to, alkylbenzene sulfonate, α-olefin sulfonate, and phosphate. In particular, those anionic surfactants having a fluoroalkyl group are preferable.

In the elongation and/or cross-linking reaction for producing the non-linear amorphous polyester resin A, a catalyst can be used.

Specific examples of the catalyst include, but are not limited to, dibutyltin laurate and dioctyltin laurate.

Removal of Organic Solvent

The organic solvent can be removed from the dispersion liquid (e.g., emulsion slurry) by gradually heating the reaction system to evaporate the organic solvent from the oil droplets, or spraying the dispersion liquid into dry atmosphere to evaporate the organic solvent from the oil droplets.

As the organic solvent has been removed, mother toner particles are formed. The mother toner particles can be subjected to washing, drying, classification, and the like processes. The classification can be performed in a liquid by means of cyclone separation, decantation, or centrifugal separation to remove ultrafine particles. Alternatively, the classification can be performed after the mother toner particles have been dried.

Mixing

The mother toner particles can be mixed with particles of the flowability improver, the charge controlling agent, and the like. At the time of mixing, it is possible to apply mechanical impact force to suppress release of the particles from the surfaces of the mother toner particles.

Mechanical impact force can be applied to the mixture by impacting the mixture with agitation blades rotating at high speeds, or accelerating the mixture in a high-speed air current to make them collide with each other or a collision plate.

Such a treatment can be performed by ONG MILL (from Hosokawa Micron Co., Ltd.), a modified I-TYPE MILL (from Nippon Pneumatic Mfg. Co., Ltd.) in which the pulverizing air pressure is reduced, HYBRIDIZATION SYSTEM (from Nara Machine Co., Ltd.), KRYPTON SYSTEM (from Kawasaki Heavy Industries, Ltd.), or an automatic mortar.

Developer

A developer in accordance with some embodiments of the present invention includes the toner described above and optional components such as a carrier.

The developer may be either one-component developer or two-component developer.

Carrier

The carrier is preferably composed of a core material and a protective layer that covers the core material.

Core Material

Specific materials usable for the core material include, but are not limited to, manganese-strontium materials having a magnetization in the range of 50 to 90 emu/g and manganese-magnesium materials having a magnetization in the range of 50 to 90 emu/g. To secure image density, high magnetization materials such as iron powders having a magnetization of 100 emu/g or more and magnetites having a magnetization in the range of 75 to 120 emu/g are preferable. Low magnetization materials such as copper-zinc materials having a magnetization in the range of 30 to 80 emu/g are also preferable because they can adsorb the impact of the ear-like developer against the photoconductor, which is advantageous in terms of image quality.

Two or more of these core materials can be used in combination.

The core material preferably has a volume average particle diameter in the range of 10 to 150 μm, more preferably in the range of 40 to 100 μm. When the volume average particle diameter is less than 10 μm, it means that the resulting carrier particles include a relatively large amount of fine particles, and therefore the magnetization per carrier particle is low enough to cause carrier scattering. When the volume average particle diameter is in excess of 150 μm, it means that the specific surface area of the carrier particle is low enough to cause toner scattering, and therefore solid portions in full-color images may not be reliably reproduced.

Protective Layer

The protective layer includes a resin.

Specific examples of the resin include, but are not limited to, amino resin, polyvinyl resin, polystyrene resin, halogenated polyolefin, polyester resin, polycarbonate resin, polyethylene, polyvinyl fluoride, polyvinylidene fluoride, polytrifluoroethylene, polyhexafluoropropylene, copolymer of vinylidene fluoride with an acrylic monomer, copolymer of vinylidene fluoride with vinyl fluoride, fluoroterpolymer (e.g., copolymer of tetrafluoroethylene, vinylidene fluoride, and a monomer having no fluoro group), and silicone resin. Two or more of these resins can be used in combination.

Specific examples of the amino resin include, but are not limited to, urea-formaldehyde resin, melamine resin, benzoguanamine resin, urea resin, polyamide resin, and epoxy resin.

Specific examples of the polyvinyl resin include, but are not limited to, acrylic resin, polymethyl methacrylate, polyacrylonitrile, polyvinyl acetate, polyvinyl alcohol, and polyvinyl butyral.

Specific examples of the polystyrene resin include, but are not limited to, polystyrene and styrene-acrylic copolymer.

Specific examples of the halogenated polyolefin include, but are not limited to, polyvinyl chloride.

Specific examples of the polyester resin include, but are not limited to, polyethylene terephthalate and polybutylene terephthalate.

The protective layer may further include a conductive powder, if needed.

Specific examples of the conductive powder include, but are not limited to, metal powder, carbon black, titanium oxide powder, tin oxide powder, and zinc oxide powder.

The conductive powder preferably has an average particle diameter of 1 μm or less. When the average particle diameter of the conductive powder is in excess of 1 μm, it may be difficult to control electric resistivity.

The protective layer can be formed by applying a coating liquid to the surface of the core material, followed by drying and baking. The coating liquid is prepared by dissolving or dispersing a composition including the resin in a solvent.

Specific methods of applying the coating liquid include, but are not limited to, dipping method, spraying method, and brush coating method.

Specific examples of the solvent include, but are not limited to, toluene, xylene, methyl ethyl ketone, methyl isobutyl ketone, and butyl acetate cellosolve.

The baking method may be either an external heating method or an internal heating method using a stationary electric furnace, a movable electric furnace, a rotary electric furnace, burner furnace, microwave, or the like.

The toner can be mixed with the carrier to be used as a two-component developer. The content of the carrier in the two-component developer is preferably from 90 to 98 parts by weight, more preferably from 93 to 97 parts by weight, based on 100 parts by weight of the two-component developer.

The developer can be used for any electrophotographic image forming methods, such as magnetic one-component developing methods, non-magnetic one-component developing methods, and two-component developing methods.

Recording Medium

Specific examples of the recording medium include, but are not limited to, plain paper usable as the above-described standard paper; and an embossed paper, specially-treated to have surface irregularity, having a basis weight in the range of 100 to 400 g/m$^2$ and a smoothness of 20 s or less, such as LEATHAC 66 and TANT (from Tokushu Tokai Paper Co., Ltd.).

Smoothness is measured with a Bekk smoothness tester in the following manner. A paper to be measured is put on a glass plate and pressed by a measuring head with a pressure of 0.1 MPa. A vessel having a constant capacity connected to the center of the glass plate is vacuumed by a vacuum pump so that the atmospheric air is sucked from the gap between the paper and the glass plate. A time it takes 10 mL of the atmospheric air to flow is measured. The measured time (s) is defined as a smoothness. A longer time indicates a higher smoothness.

In accordance with some embodiments of the present invention, the image forming apparatus has a print mode for making prints on a recording medium having a smoothness of 20 s or less.

In particular, this print mode is provided for users as a user-selectable special mode for making prints on "recording medium having surface irregularity". When this mode is selected by a user, at least one of the following control changes (1) to (3) are applied to the regular mode that is for making prints on plain paper having basis weight in the range of 50 to 100 g/m$^2$.

(1) Raising the fixing temperature.

(2) Reducing the linear speed.

(3) Raising the surface pressure in the nip portion.

Photoconductor

The photoconductor is not limited in material, structure, and size. Specific usable materials include, but are not limited to, inorganic photoconductors such as amorphous silicon and selenium, and organic photoconductors such as polysilane and phthalopolymethyne. Among these materials, amorphous silicon is advantageous in terms of its long lifespan. Electrostatic Latent Image Forming Device The electrostatic latent image forming device is not limited to any particular device so long as it forms an electrostatic latent image on the photoconductor. The electrostatic latent image forming device may include, for example, a charger for charging a surface of the photoconductor and an irradiator for irradiating the surface of the photoconductor with light containing image information.

Charger and Charging Process

Specific examples of the charger include, but are not limited to, a contact charger equipped with a conductive or semiconductive roller, brush, film, or rubber blade, and a non-contact charger such as corotron and scorotron that use corona discharge.

The charging process can be performed by applying a voltage to a surface of the photoconductor by the charger.

Irradiator and Irradiating Process

The irradiator is not limited to any particular device so long as it irradiates the surface of the photoconductor charged by the charger with light containing image information. Specific examples of the irradiator include, but are not limited to, a radiation optical irradiator, a rod lens array irradiator, a laser optical irradiator, and a liquid crystal shutter optical irradiator.

The irradiating process can be performed by irradiating the surface of the photoconductor with light containing image information by the irradiator.

Developing Device

The developing device is not limited to any particular device so long as it contains a toner for developing the electrostatic latent image formed on the photoconductor into a visible image.

For example, a developing device capable of containing the developer and supplying toner to the electrostatic latent image with or without contacting the electrostatic latent image can be used.

The developing device may employ either a dry developing method or a wet developing method. The developing device may employ either a single-color developing device or a multi-color developing device.

For example, a developing device including a stirrer for stirring the toner to frictionally charge it and a rotatable developer bearer can be used.

In the developing device, toner particles and carrier particles are mixed and stirred, and the toner particles are charged by friction. The charged toner particles and carrier particles are formed into ear-like aggregation and retained on the surface of the magnet roller that is rotating, thus forming a magnetic brush. The magnet roller is disposed near the electrostatic latent image bearer. Therefore, a part of the toner particles forming the magnetic brush migrates from the surface of the magnet roller to the surface of the photoconductor owing to an electrical attractive force. As a result, the electrostatic latent image formed on the photoconductor is developed into a toner image. The developer contained in the developing device may be either a one-component developer or a two-component developer.

Transfer Device

The transfer device is not limited to any particular device so long as it transfers the visible image onto a recording medium. Preferably, the transfer device includes a primary transfer device for transferring the visible image onto an intermediate transfer medium to form a composite transfer image, and a secondary transfer device for transferring the composite transfer image onto a recording medium.

When the image to be secondarily transferred onto the recording medium is a color image composed of multiple toners having different colors, each color toner image is sequentially superimposed on one another on the intermediate transfer medium to form a composite image thereon, and then the composite image is secondarily transferred from the intermediate transfer medium onto the recording medium.

Specific examples of the intermediate transfer medium include, but are not limited to, a transfer belt.

Preferably, the transfer device (the primary transfer device, the secondary transfer device) includes a transferrer for charging the visible image to detach it from the photoconductor toward the recording medium. Specific examples of the transferrer include, but are not limited to, a corona transferrer employing corona discharge, a transfer belt, a transfer roller, a pressure transfer roller, and an adhesive transferrer.

Fixing Device

The fixing device is not limited to any particular device so long as it fixes the transfer image on the recording medium. Specific examples of the fixing device include, but are not limited to, a heat-pressure member. Specific examples of the heat-pressure member include, but are not limited to, a combination of a heat roller and a pressure roller, and a combination of a heat roller, a pressure roller, and an endless belt.

Figure 2:
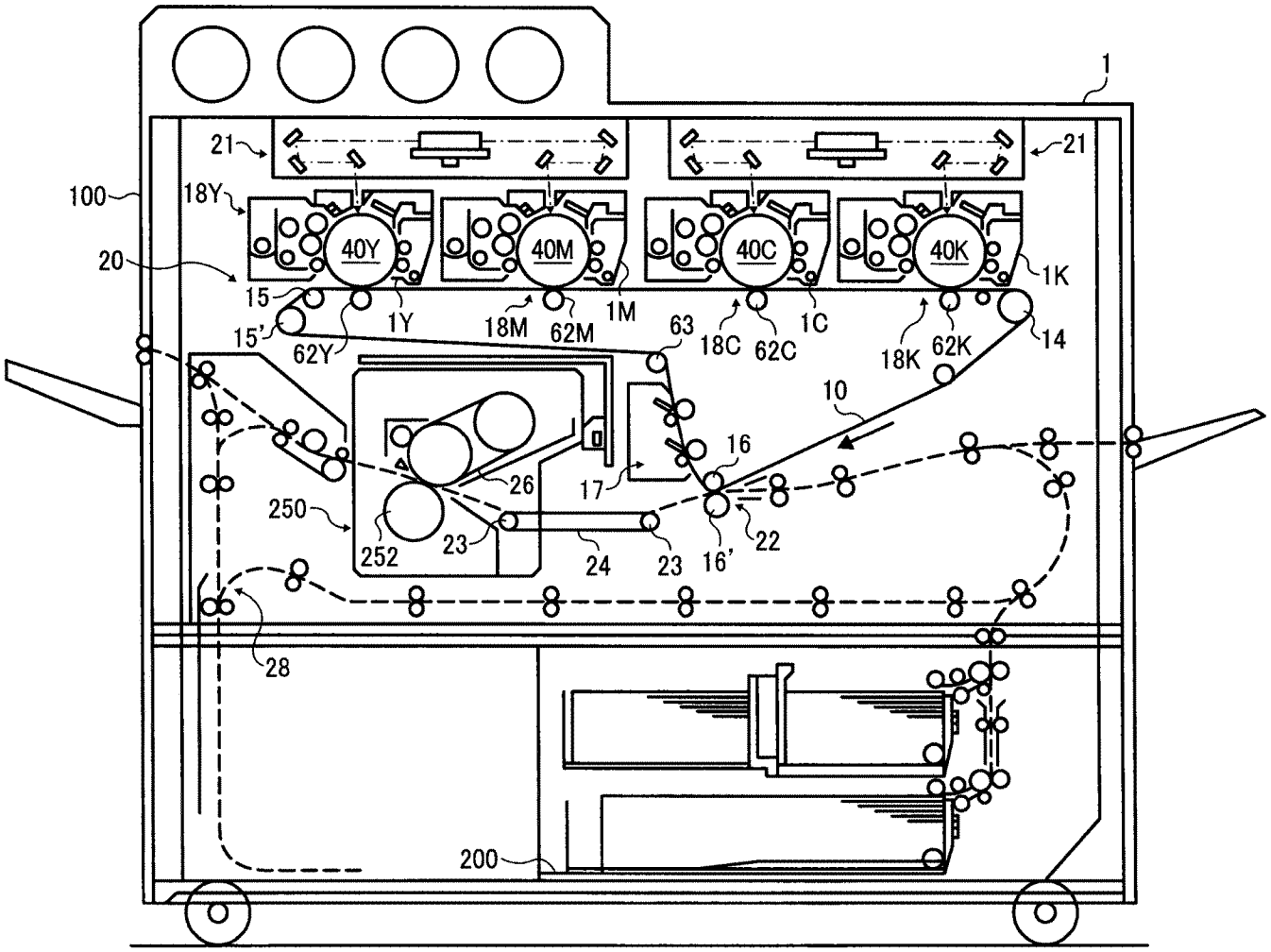
FIG. 2 is a schematic view of an image forming apparatus according to an embodiment of the present invention.

One example of the fixing device is a fixing device 250 included in an image forming apparatus illustrated in FIG. 2. Detailed configuration of the fixing device 250 is described with reference to FIG. 3.

The fixing device 250 includes an endless flexible fixing belt 26, a pressure roller 252, a fixing roller 253, a heat roller 254, and a halogen heater 25.

The fixing belt 26 is supported by the fixing roller 253 and the heat roller 254.

The fixing roller 253 is composed of a cored bar 41 and an elastic layer 42 formed thereon.

Specific materials usable for the cored bar 41 include, but are not limited to, metallic materials such as stainless steel and aluminum.

Specific materials usable for the elastic layer 42 include, but are not limited to, rubber materials such as foamed silicone rubber, silicone rubber, and fluorine rubber.

The halogen heater 25 is disposed inside the heat roller 254.

Figure 4:
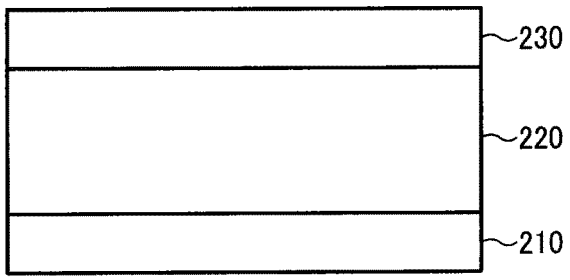
FIG. 4 is a cross-sectional view of a fixing belt included in the fixing device illustrated in FIG. 3.

Referring to FIG. 4, the fixing belt 26 includes, form the innermost side thereof, a base material 210, an elastic layer 220, and a release layer 230.

The fixing belt 26 preferably has a thickness of 1 mm or less.

The base material 210 preferably has a thickness in the range of 20 to 50 μm.

Specific materials usable for the base material 210 include, but are not limited to, metallic materials such as nickel and stainless steel, and resin materials such as polyimide. Among these materials, nickel and polyimide are preferable because they provide excellent low-temperature fixability.

The elastic layer 220 preferably has a thickness t1 in the range of 300 to 500 μm. When the thickness is less than 300 μm, the elastic layer 220 cannot follow micro surface irregularity of toner images and embossed paper, resulting in deterioration in low-temperature fixability.

Specific materials usable for the elastic layer 220 include, but are not limited to, rubber materials such as silicone rubber, foamed silicone rubber, and fluorine rubber.

The release layer 230 preferably has a thickness t2 of 10 μm or less. When the thickness is in excess of 10 μm, the release layer 230 cannot follow micro surface irregularity of toner images and embossed paper, resulting in deterioration in low-temperature fixability.

Specific materials usable for the release layer 230 include, but are not limited to, PFA (tetrafluoroethylene-perfluoroalkyl vinyl ether copolymer), PTFE (polytetrafluoroethylene), polyimide, polyetherimide, and PES (polyether sulfide).

The fixing belt 26 normally has a Martens hardness of 2.0 $N/mm^2$ or more at 23° C., but it is preferably 1.0 $N/mm^2$ or less, and more preferably 0.5 $N/mm^2$ or less, in the present invention. When the Martens hardness at 23° C. is in excess of 1.0 $N/mm^2$, the fixing belt 26 cannot follow micro surface irregularity of toner images and embossed paper, resulting in deterioration in low-temperature fixability.

The surface pressure in a nip portion N is preferably 2.0 $kgf/cm^2$ or more. When the surface pressure in the nip portion is less than 2.0 $kgf/cm^2$, micro surface irregularity of toner images and embossed paper cannot be followed. When the surface pressure in the nip portion is in excess of 3.0 $kgf/cm^2$, the fixing device 250 deteriorates in durability.

Both ends of the halogen heater 25 are fixed to side walls of the fixing device 250. The fixing belt 26 is heated by radiation heat from the halogen heater 25. The halogen heater 25 is output-controlled by a power supply part in an image forming apparatus 1 illustrated in FIG. 2 (to be described in detail later). The surface of the fixing belt 26 applies heat to a color toner image T on a recording medium P. The halogen heater 25 is output-controlled based on the surface temperature of the fixing belt 26 detected by a thermopile disposed facing the surface of the fixing belt 26. By controlling the output of the halogen heater 25, the surface temperature of the fixing belt 26 can be adjusted to a desired temperature.

In the fixing device 250, the fixing belt 26 is heated almost entirely in the peripheral direction, not locally heated in part. The fixing belt 26 can be sufficiently heated enough to suppress the occurrence of detective fixing even when the fixing device 250 is increased in speed. The fixing device 250 can effectively heat the fixing belt 26 with a relatively simple configuration. Therefore, the fixing device 250 can be shortened in warm up time and first print time as well as reduced in size.

The pressure roller 252 includes, form the innermost side thereof, a cored bar 31, an elastic layer 32, and a release layer 33.

Specific materials usable for the cored bar 31 include, but are not limited to, metallic materials such as stainless steel and aluminum.

Specific materials usable for the elastic layer 32 include, but are not limited to, rubber materials such as foamed silicone rubber, silicone rubber, and fluorine rubber.

Specific materials usable for the release layer 33 include, but are not limited to, PFA and PTFE.

Figure 3:
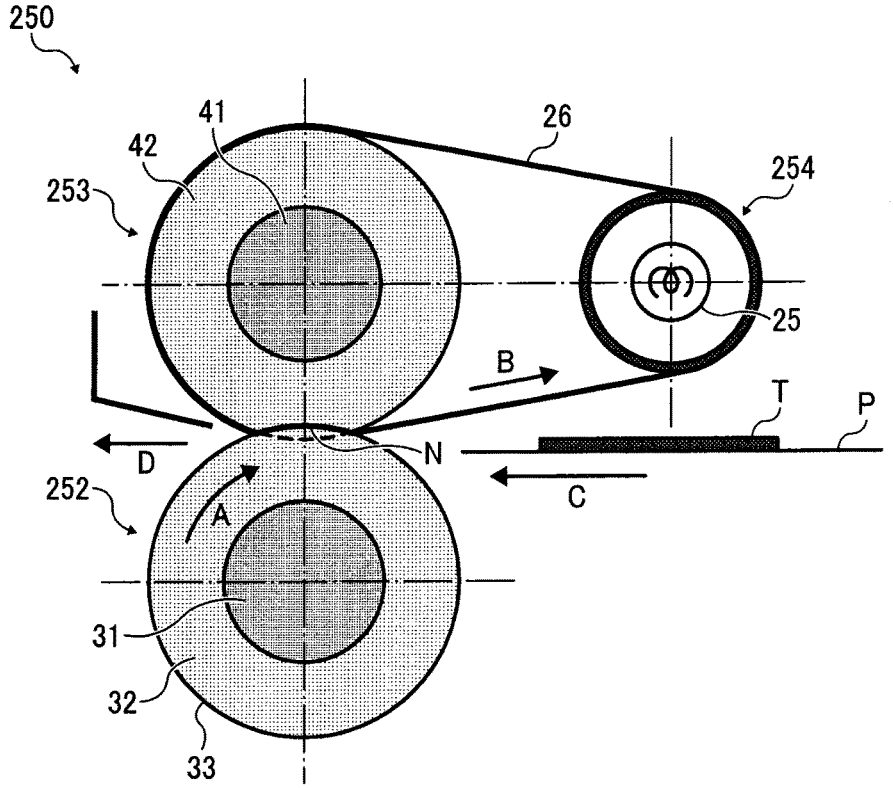
FIG. 3 is a schematic view of a fixing device included in the image forming apparatus illustrated in FIG. 2.

The pressure roller 252 has a gear engaged with a drive gear in a drive mechanism, and is driven to rotate clockwise in FIG. 3. Both axial ends of the pressure roller 252 are rotatably supported by side walls of the fixing device 250 via bearings.

A heat source, such as halogen heater, can be provided inside the pressure roller 252. The outer diameter of the fixing roller 253 is equivalent to that of the pressure roller 252. Alternatively, the outer diameter of the fixing roller 253 may be smaller than that of the pressure roller 252. In the latter case, the curvature of the fixing roller 253 is smaller than that of the pressure roller 252, and therefore the recording medium P can be more easily separated from the fixing belt 251.

Other Devices and Other Processes

The other devices to be optionally included may be, for example, a cleaner, a neutralizer, a recycler, and/or a controller.

An image forming method using the image forming apparatus according to an embodiment of the present invention is described below with reference to FIG. 2.

FIG. 2 is a schematic view of an image forming apparatus according to an embodiment of the present invention. This image forming apparatus 1 includes a main body 100 employing a tandem intermediate transfer method, and a paper feeding table 200 supporting the main body 100. The main body 100 has a tandem image forming part 20 employing a tandem intermediate transfer method. In the image forming part 20, image forming units 1Y, 1M, 1C, and 1K are tandemly arranged. Here, the additional characters Y, M, C, and K respectively represent the colors of yellow, magenta, cyan, and black. At the center of the main body 100, an intermediate transfer belt 10 in the form of a seamless belt is disposed. The intermediate transfer belt 10 is stretched across multiple support rollers 14, 15, 15', and 16 and is rotatable clockwise in FIG. 2.

A cleaner 17 for cleaning the intermediate transfer belt 10 is disposed on the left side of the support roller 16 in FIG. 2. The cleaner 17 removes residual toner particles remaining on the intermediate transfer belt 10 after image transfer.

Four image forming units 1Y, 1M, 1C, and 1K for forming toner images of yellow, magenta, cyan, and black, respectively, are laterally arranged in tandem facing a surface of the intermediate transfer belt 10 stretched between the support rollers 14 and 15, thus forming the tandem image forming part 120. The image forming units 1Y, 1M, 1C, and 1K include photoconductor drums 40Y, 40M, 40C, and 40K, respectively, each serving as an image bearer for bearing a toner image.

Above the tandem image forming part 20, two irradiators 21 are disposed. One of the irradiators 21 corresponds to two image forming units 1Y and 1M, and the other corresponds to the other two image forming units 1C and 1K. Each of the irradiators 21 may be an optical scanning irradiator composed of two light sources (e.g., semiconductor laser, semiconductor laser array, multibeam light source), a coupling optical system, a common optical deflector (e.g., polygon mirror), two-types of scanning imaging forming optical systems, and the like. The irradiators 21 irradiate photoconductor drums 40Y, 40M, 40C, and 40K based on image information of yellow, magenta, cyan, and black, respectively, to form electrostatic latent images of each color.

Around each of the photoconductor drums 40Y, 40M, 40C, and 40K, a charger for uniformly charging the photoconductor drum prior to the light irradiation, a developing device 18Y, 18M, 18C, and 18K for developing an electrostatic latent image formed by the irradiator 21, and a photoconductor cleaner for removing residual toner particles remaining on the photoconductor drum are provided. At a primary transfer position where a toner image is transferred from the photoconductor drum 40Y, 40M, 40C, or 40K onto the intermediate transfer belt 10, a primary transfer roller 62Y, 62M, 62C, or 62K is disposed facing the corresponding photoconductor drum 40Y, 40M, 40C, or 40K with the intermediate transfer belt 10 therebetween.

Among the multiple support rollers supporting the intermediate transfer belt 10, the support roller 14 is a driving roller for driving the intermediate transfer belt 10 to rotate. The support roller 14 is connected to a motor through a drive transmission mechanism (e.g., gear, pulley, belt). In the case of forming a black monochrome image on the intermediate transfer belt 10, the support rollers 15 and 15' are displaced so that the intermediate transfer belt 10 is drawn away from the photoconductor drums 40Y, 40M, and 40C.

On the opposite side of the tandem image forming part 20 with respect to the intermediate transfer belt 10, a secondary transfer device 22 is disposed. The secondary transfer device 22 applies a transfer electric field while a secondary transfer roller 16' is pressed against a secondary transfer facing roller 16, thereby transferring a toner image carried on the intermediate transfer belt 10 onto a recording medium P.

The fixing device 250 for fixing the transferred image on the recording medium P is disposed adjacent to the secondary transfer device 22. The fixing device 250 includes the fixing belt 26 in the form of a seamless belt and the pressure roller 252 pressed against the fixing belt 26. The fixing belt 26 is stretched across two support rollers. At least one of the support roller is equipped with a heating device (e.g., heater, lamp, electromagnetic heater).

The recording medium P having the toner image transferred by the secondary transfer device 22 is conveyed to the fixing device 250 by a conveying belt 24 supported with two rollers 23. The conveying belt 24 can be replaced with a fixed guide member, a conveying roller, or the like.

Below the secondary transfer device 22 and the fixing device 250, a sheet reversing device 28 is disposed in parallel with the tandem image forming part 20. The sheet reversing device 28 reverses a sheet upside down so that images can be formed on both sides of the recording medium P.

Operation of the fixing device 250 is described with reference to FIGS. 2 and 3. As a power switch of the image forming apparatus 1 is turned on, the halogen heater 25 is supplied with electric power, and the pressure roller 252 is driven to rotate in the direction indicated by arrow A in FIG. 3. At this time, the fixing belt 26 is also rotated in the direction indicated by arrow B in FIG. 3 by the friction force with the pressure roller 252. A recording medium P is fed from the paper feeding part. A color toner image T is transferred onto the recording medium P at a position of the secondary transfer roller 16'. The recording medium P having the color toner image T thereon is guided by an inlet guide plate, conveyed in the direction indicated by arrow C in FIG. 3, and introduced into the nip N formed between the fixing belt 26 and the pressure roller 252. The color toner image T is fixed on the recording medium P by application of heat from the fixing belt 26 heated by the halogen heater 25 and pressure between the fixing roller 253 and the pressure roller 252. The recording medium P discharged from the nip N is guided by a separation plate and an outlet guide plate, and conveyed in the direction indicated by arrow D in FIG. 3.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, the "%" represents percentage in weight, unless otherwise specified.

Separation of THF-Soluble and THF-Insoluble

A toner in an amount of 1 g is stirred in 100 mL of THF at 25° C. for 30 minutes. The resultant liquid is filtered with a membrane filter having an opening of 0.2 μm. THF-insoluble is obtained by collecting the residue. THF-soluble is obtained by drying the filtrate.

Measurement of Adhesion Force

An adhesion force between a toner layer and a standard paper is measured in the following manner. As a measuring device, a tacking tester TAC-II available from Rhesca Corporation, illustrated in FIG. 1 is used.

1) A standard paper P 105 having an unfixed toner thereon is set on a stage 106. The standard paper P 105 is a commercially-available paper TYPE 6000 <70W> from Ricoh Co., Ltd. The toner deposition amount is 0.85 $mg/cm^2$.

2) A probe 102 having a diameter of 10 mm is set to a load sensor 101.

3) A power switch 109 is pressed to display main menu.

4) On a setting display panel 108, "[1] Tackiness Test" is selected. As the control method, "[1] Constant Load" is selected.

5) In "PARAMETER SETTING", parameters are set as follows.

Immersion Speed: 120 mm/min

Test Speed: 600 mm/min

Preload: 1,000 gf

Press Time: 0.1 sec

Distance: 5 mm

6) One of temperature controllers 107 on the probe 102 side is set to 140° C. The other temperature controller 107 on the stage side is set to 0° C.

7) A thermocouple is brought into contact with a surface A of the probe 102 from outside to check the temperature. When the temperature is lower than 140° C., the temperature settings of the temperature controllers 107 are turned up. When the temperature is higher than 140° C., the temperature settings of the temperature controllers 107 are turned down.

8) After a lapse of 5 minutes or longer since the temperature has reached 140° C., an elastic double-faced tape 103 is attached to the surface A of the probe 102. The elastic double-faced tape 103 is a 3M™ VHB™ tape having a thickness of 1.1 mm (from Sumitomo 3M).

9) After a lapse of 5 minutes or longer, a measurement start switch 110 is pressed.

10) At the end of the measurement, measurement results are displayed on the setting display panel 108 and "Peak Load (gf)" is recorded.

Measurement of Storage Elastic Modulus G'

Storage elastic modulus G' is measured with a dynamic viscoelasticity measurement device ARES Rheometer (from TA Instruments). A sample is pelletized into a pellet having a diameter of 8 mm and a thickness of 1 mm. The pellet is set between parallel plates having a diameter of 8 mm, stabilized at 40° C., and subjected to a measurement under a frequency of 1 Hz (6.28 rad/s) and deformation control mode with an amount of deformation of 0.1% while raising temperature to 200° C. at a rate of 2.0° C./min.

Measurement of Glass Transition Temperatures

Tg1st and Tg2nd Melting point and glass transition temperature are measured with a differential scanning calorimeter Q-200 (from TA Instruments). First, a sample container is charged with about 5.0 mg of a sample, put on a holder unit, and set in an electric furnace. The sample is heated from −80° C. to 150° C. at a heating rate of 10° C./min in nitrogen atmosphere (i.e., the first heating). The sample is then cooled from 150° C. to −80° C. at a cooling rate of 10° C./min, and reheated to 150° C. at a heating rate of 10° C./min (i.e., the second heating).

A glass transition temperature Tg1st is determined by analyzing a DSC curve obtained in the first heating with an analysis program included in the Q-200 system.

A glass transition temperature Tg2nd is determined by analyzing a DSC curve obtained in the second heating with an analysis program included in the Q-200 system.

Evaluation of Heat-Resistant Storage Stability

Each toner is filled in a 50-mL glass container and left in a constant-temperature chamber at 50° C. for 24 hours. The toner is then cooled to 24° C. and subject to a penetration test (JIS K2235-1991) to determine a penetration (penetration depth). Heat-resistant storage stability is evaluated based on the following criteria.

AA: Penetration is 25 mm or more.

A: Penetration is not less than 15 mm and less than 25 mm.

B: Penetration is not less than 5 mm and less than 15 mm.

C: Penetration is less than 5 mm.

Measurement of Martens Hardness

Fixing belts are subjected to a measurement of Martens hardness as follows.

Each fixing belt is cut into a square with each side having a length of 10 mm. The cut specimen is put on a stage of a hardness measuring device Fischerscope H-100 (from Fischer Instruments K.K. Japan) with its release layer up, and subjected to a measurement at 23° C. The measurement is a load-unload repeat test using a micro-Vickers indenter. The maximum indention depth is set to 20 μm, and the retention time is set to 30 seconds. Ten randomly-selected portions on the specimen are subjected to the test, and the ten measured values are averaged to determine Martens hardness of the fixing belt.

Preparation of Toners 10 to 27

Synthesis of Ketimine 1

A reaction vessel equipped with a stirrer and a thermometer is charged with 170 parts of isophoronediamine and 75 parts of methyl ethyl ketone. The mixture is subjected to a reaction for 5 hours at 50° C. Thus, a ketimine 1 is prepared. The ketimine 1 has an amine value of 418 mgKOH/g.

Synthesis of Non-linear Amorphous Polyester Resin D-1

Synthesis of Prepolymer

A reaction vessel equipped with a condenser, a stirrer, and a nitrogen inlet tube is charged with 3-methyl-1,5-pentanediol, isophthalic acid, and adipic acid in such amounts that the molar ratio [OH]/[COOH] of hydroxyl groups to carboxyl groups becomes 1.1. In this case, diol components consist of 100% by mol of 3-methyl-1,5-pentanediol, and dicarboxylic acid components consist of 45% by mol of isophthalic acid and 55% by mol of adipic acid. Further, trimethylolpropane in an amount of 1.5% by mol based on total monomers and titanium tetraisopropoxide in an amount of 1,000 ppm based on total monomers are added to the vessel. The vessel contents are heated to 200° C. over a period of about 4 hours, then heated to 230° C. over a period of 2 hours, and subjected to a reaction until outflow water is not produced. The vessel contents are further subjected to a reaction under reduced pressures in the range of 10 to 15 mmHg for 5 hours. Thus, a polyester having hydroxyl group is obtained.

Next, a reaction vessel equipped with a condenser, a stirrer, and a nitrogen inlet tube is charged with the polyester having hydroxyl group and isophorone diisocyanate (IPDI) in such amounts that the molar ratio [NCO]/[OH] of isocyanate groups to hydroxyl groups becomes 2.0. The vessel contents are diluted with ethyl acetate, and subjected to a reaction at 100° C. for 5 hours. Thus, a 50% ethyl acetate solution of a polyester prepolymer having an isocyanate group is prepared.

Synthesis of Non-linear Amorphous Polyester Resin D-1

The 50% ethyl acetate solution of a polyester prepolymer having an isocyanate group is stirred in a reaction vessel equipped with a heater, a stirrer, and a nitrogen inlet tube. The ketimine 1 is dropped in the reaction vessel in such an amount that the molar ratio $[NH_2]/[NCO]$ of amino groups to isocyanate groups becomes 1.0. The vessel contents are stirred at 45° C. for 10 hours and then subjected to reduced-pressure drying at 50° C. until the ethyl acetate content becomes 100 ppm or less. Thus, a non-linear amorphous polyester resin D-1 is obtained. The non-linear amorphous polyester resin D-1 has a weight average molecular weight of 164,000 and a glass transition temperature of −40° C.

Synthesis of Non-linear Amorphous Polyester Resin D-2

A reaction vessel equipped with a condenser, a stirrer, and a nitrogen inlet tube is charged with 3-methyl-1,5-pentanediol and adipic acid in such amounts that the molar ratio [OH]/[COOH] of hydroxyl groups to carboxyl groups becomes 1.1. Further, trimethylolpropane in an amount of 1.5% by mol based on total monomers and titanium tetraisopropoxide in an amount of 1,000 ppm based on total monomers are added to the vessel. The vessel contents are heated to 200° C. over a period of about 4 hours, then heated to 230° C. over a period of 2 hours, and subjected to a reaction until outflow water is not produced. The vessel contents are further subjected to a reaction under reduced pressures in the range of 10 to 15 mmHg for 5 hours. Thus, a polyester having hydroxyl group is obtained.

The procedure for obtaining the non-linear amorphous polyester resin D-1 is repeated except that the polyester having hydroxyl group is replaced with that prepared above. Thus, a non-liner amorphous polyester resin D-2 is obtained. The non-linear amorphous polyester resin D-2 has a weight average molecular weight of 175,000 and a glass transition temperature of −55° C.

Synthesis of Non-Linear Amorphous Polyester Resin D-3

A reaction vessel equipped with a condenser, a stirrer, and a nitrogen inlet tube is charged with ethylene oxide 2 mol adduct of bisphenol A, propylene oxide 2 mol adduct of bisphenol A, terephthalic acid, and trimellitic anhydride in such amounts that the molar ratio [OH]/[COOH] of hydroxyl groups to carboxyl groups becomes 1.3. In this case, diol components consist of 90% by mol of ethylene oxide 2 mol adduct of bisphenol A and 10% by mol of propylene oxide 2 mol adduct of bisphenol A, and polycarboxylic acid components consist of 90% by mol of terephthalic acid and 10% by mol of trimellitic anhydride. Further, tetraisopropoxide in an amount of 1,000 ppm based on total monomers are added to the vessel. The vessel contents are heated to 200° C. over a period of about 4 hours, then heated to 230° C. over a period of 2 hours, and subjected to a reaction until outflow water is not produced. The vessel contents are further subjected to a reaction under reduced pressures in the range of 10 to 15 mmHg for 5 hours. Thus, a polyester having hydroxyl group is obtained.

The procedure for obtaining the non-linear amorphous polyester resin D-1 is repeated except that the polyester having hydroxyl group is replaced with that prepared above. Thus, a non-liner amorphous polyester resin D-3 is obtained. The non-linear amorphous polyester resin D-3 has a weight average molecular weight of 130,000 and a glass transition temperature of 54° C.

Synthesis of Non-Linear Amorphous Polyester Resin D-4

A reaction vessel equipped with a condenser, a stirrer, and a nitrogen inlet tube is charged with 1,2-propylene glycol, terephthalic acid, and adipic acid in such amounts that the molar ratio [OH]/[COOH] of hydroxyl groups to carboxyl groups becomes 1.3. In this case, dicarboxylic acid components consist of 80% by mol of terephthalic acid and 20% by mol of adipic acid. Further, trimellitic anhydride in an amount of 2.5% by mol based on total monomers and titanium tetraisopropoxide in an amount of 1,000 ppm based on total monomers are added to the vessel. The vessel contents are heated to 200° C. over a period of about 4 hours, then heated to 230° C. over a period of 2 hours, and subjected to a reaction until outflow water is not produced. The vessel contents are further subjected to a reaction under reduced pressures in the rage of 10 to 15 mmHg for 5 hours. Thus, a polyester having hydroxyl group is obtained.

The procedure for obtaining the non-linear amorphous polyester resin D-1 is repeated except that the polyester having hydroxyl group is replaced with that prepared above. Thus, a non-liner amorphous polyester resin D-4 is obtained. The non-linear amorphous polyester resin D-4 has a weight average molecular weight of 140,000 and a glass transition temperature of 56° C.

Synthesis of Non-Linear Amorphous Polyester Resin D-5

A reaction vessel equipped with a condenser, a stirrer, and a nitrogen inlet tube is charged with 3-methyl-1,5-pentanediol, isophthalic acid, and adipic acid in such amounts that the molar ratio [OH]/[COOH] of hydroxyl groups to carboxyl groups becomes 1.5. In this case, dicarboxylic acid components consist of 40% by mol of isophthalic acid and 60% by mol of adipic acid. Further, trimellitic anhydride in an amount of 1% by mol based on total monomers and titanium tetraisopropoxide in an amount of 1,000 ppm based on total monomers are added to the vessel. The vessel contents are heated to 200° C. over a period of about 4 hours, then heated to 230° C. over a period of 2 hours, and subjected to a reaction until outflow water is not produced. The vessel contents are further subjected to a reaction under reduced pressures in the rage of 10 to 15 mmHg for 5 hours. Thus, a polyester having hydroxyl group is obtained.

The procedure for obtaining the non-linear amorphous polyester resin D-1 is repeated except that the polyester having hydroxyl group is replaced with that prepared above. Thus, a non-liner amorphous polyester resin D-5 is obtained. The non-linear amorphous polyester resin D-5 has a weight average molecular weight of 150,000 and a glass transition temperature of −35° C.

Synthesis of Linear Amorphous Polyester Resin E-1

A reaction vessel equipped with a nitrogen inlet tube, a dewatering tube, a stirrer, and a thermocouple is charged with ethylene oxide 2 mol adduct of bisphenol A, propylene oxide 2 mol adduct of bisphenol A, terephthalic acid, and adipic acid in such amounts that the molar ratio [OH]/[COOH] of hydroxyl groups to carboxyl groups becomes 1.3. In this case, diol components consist of 60% by mol of ethylene oxide 2 mol adduct of bisphenol A and 40% by mol of propylene oxide 2 mol adduct of bisphenol A, and dicarboxylic acid components consist of 93% by mol of terephthalic acid and 7% by mol of adipic acid. Further, tetraisopropoxide in an amount of 500 ppm based on total monomers are added to the vessel. The vessel contents are subjected to a reaction at 230° C. for 8 hours, and subsequently under reduced pressures in the range of 10 to 15 mmHg for 4 hours. After adding trimellitic anhydride in an amount of 1% by mol based on total monomers to the vessel, the vessel contents are subjected to a reaction at 180° C. for 3 hours. Thus, a linear amorphous polyester resin E-1 is obtained. The linear amorphous polyester resin E-1 has a weight average molecular weight of 5,300 and a glass transition temperature of 67° C.

Synthesis of Linear Amorphous Polyester Resin E-2

A reaction vessel equipped with a nitrogen inlet tube, a dewatering tube, a stirrer, and a thermocouple is charged with propylene oxide 2 mol adduct of bisphenol A, 1,3-propylene glycol, terephthalic acid, and adipic acid in such amounts that the molar ratio [OH]/[COOH] of hydroxyl groups to carboxyl groups becomes 1.4. In this case, diol components consist of 90% by mol of propylene oxide 2 mol adduct of bisphenol A and 10% by mol of 1,3-propylene glycol, and dicarboxylic acid components consist of 80% by mol of terephthalic acid and 20% by mol of adipic acid. Further, tetraisopropoxide in an amount of 500 ppm based on total monomers are added to the vessel. The vessel contents are subjected to a reaction at 230° C. for 8 hours, and subsequently under reduced pressures in the range of 10 to 15 mmHg for 4 hours. After adding trimellitic anhydride in an amount of 1% by mol based on total monomers to the vessel, the vessel contents are subjected to a reaction at 180° C. for 3 hours. Thus, a linear amorphous polyester resin E-2 is obtained. The linear amorphous polyester resin E-2 has a weight average molecular weight of 5,600 and a glass transition temperature of 61° C.

Synthesis of Linear Amorphous Polyester Resin E-3

A reaction vessel equipped with a nitrogen inlet tube, a dewatering tube, a stirrer, and a thermocouple is charged with ethylene oxide 2 mol adduct of bisphenol A, propylene oxide 2 mol adduct of bisphenol A, isophthalic acid, and adipic acid in such amounts that the molar ratio [OH]/[COOH] of hydroxyl groups to carboxyl groups becomes 1.2. In this case, diol components consist of 80% by mol of ethylene oxide 2 mol adduct of bisphenol A and 20% by mol of propylene oxide 2 mol adduct of bisphenol A, and dicarboxylic acid components consist of 80% by mol of terephthalic acid and 20% by mol of adipic acid. Further, tetraisopropoxide in an amount of 500 ppm based on total monomers are added to the vessel. The vessel contents are subjected to a reaction at 230° C. for 8 hours, and subsequently under reduced pressures in the range of 10 to 15 mmHg for 4 hours. After adding trimellitic anhydride in an amount of 1% by mol based on total monomers to the vessel, the vessel contents are subjected to a reaction at 180° C. for 3 hours. Thus, a linear amorphous polyester resin E-3 is obtained. The linear amorphous polyester resin E-3 has a weight average molecular weight of 5,500 and a glass transition temperature of 50° C.

Synthesis of Linear Amorphous Polyester Resin E-4

A reaction vessel equipped with a nitrogen inlet tube, a dewatering tube, a stirrer, and a thermocouple is charged with ethylene oxide 2 mol adduct of bisphenol A, propylene oxide 3 mol adduct of bisphenol A, isophthalic acid, and adipic acid in such amounts that the molar ratio [OH]/[COOH] of hydroxyl groups to carboxyl groups becomes 1.3. In this case, diol components consist of 85% by mol of ethylene oxide 2 mol adduct of bisphenol A and 15% by mol of propylene oxide 3 mol adduct of bisphenol A, and dicarboxylic acid components consist of 80% by mol of terephthalic acid and 20% by mol of adipic acid. Further, tetraisopropoxide in an amount of 500 ppm based on total monomers are added to the vessel. The vessel contents are subjected to a reaction at 230° C. for 8 hours, and subsequently under reduced pressures in the range of 10 to 15 mmHg for 4 hours. After adding trimellitic anhydride in an amount of 1% by mol based on total monomers to the vessel, the vessel contents are subjected to a reaction at 180° C. for 3 hours. Thus, a linear amorphous polyester resin E-4 is obtained. The linear amorphous polyester resin E-4 has a weight average molecular weight of 5,000 and a glass transition temperature of 48° C.

Synthesis of Linear Amorphous Polyester Resin E-5

A reaction vessel equipped with a nitrogen inlet tube, a dewatering tube, a stirrer, and a thermocouple is charged with ethylene oxide 2 mol adduct of bisphenol A, propylene oxide 3 mol adduct of bisphenol A, terephthalic acid, and adipic acid in such amounts that the molar ratio [OH]/[COOH] of hydroxyl groups to carboxyl groups becomes 1.3. In this case, diol components consist of 85% by mol of ethylene oxide 2 mol adduct of bisphenol A and 15% by mol of propylene oxide 3 mol adduct of bisphenol A, and dicarboxylic acid components consist of 80% by mol of terephthalic acid and 20% by mol of adipic acid. Further, tetraisopropoxide in an amount of 500 ppm based on total monomers are added to the vessel. The vessel contents are subjected to a reaction at 230° C. for 8 hours, and subsequently under reduced pressures in the range of 10 to 15 mmHg for 4 hours. After adding trimellitic anhydride in an amount of 1% by mol based on total monomers to the vessel, the vessel contents are subjected to a reaction at 180° C. for 3 hours. Thus, a linear amorphous polyester resin E-5 is obtained. The linear amorphous polyester resin E-5 has a weight average molecular weight of 5,000 and a glass transition temperature of 51° C.

Synthesis of Crystalline Polyester Resin F-1

A reaction vessel equipped with a nitrogen inlet tube, a dewatering tube, a stirrer, and a thermocouple is charged with sebacic acid and 1,6-hexanediol in such amounts that the molar ratio [OH]/[COOH] of hydroxyl groups to carboxyl groups becomes 0.9. Further, tetraisopropoxide in an amount of 500 ppm based on total monomers are added to the vessel, and the vessel contents are subjected to a reaction at 180° C. for 10 hours. The vessel contents are then subjected to a reaction at 200° C. for 3 hours, and subsequently under a reduced pressure of 8.3 kPa for 4 hours. Thus, a crystalline polyester resin F-1 is obtained. The crystalline polyester resin F-1 has a weight average molecular weight of 25,000 and a melting point of 67° C.

Preparation of Toner 10

Preparation of Master Batch

First, 1,200 parts of water, 50 parts of a carbon black Printex 35 (from Degussa) having a DBP oil absorption amount of 42 mL/100 mg and a pH of 9.5, and 500 parts of the linear amorphous polyester resin E-1 are mixed with a HENSCHEL MIXER (from Mitsui Mining Company, Ltd.). The mixture is kneaded with double rolls at 150° C. for 30 minutes. The kneaded mixture is rolled and cooled. The rolled mixture is pulverized with a pulverizer. Thus, a master batch is obtained.

Preparation of Release Agent Dispersion Liquid

A vessel equipped with a stirrer and a thermometer is charged with 50 parts of a paraffin wax HNP-9 (from Nippon Seiro Co., Ltd.) having a melting point of 75° C. and 450 parts of ethyl acetate. The vessel contents are heated to 80° C. while being stirred and maintained for 5 hours. After being cooled to 30° C. over a period of 1 hour, the vessel contents are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a release agent dispersion liquid is obtained.

Preparation of Crystalline Polyester Resin Dispersion Liquid

A vessel equipped with a stirrer and a thermometer is charged with 50 parts of the crystalline polyester resin F-1 and 450 parts of ethyl acetate. The vessel contents are heated to 80° C. while being stirred and maintained for 5 hours. After being cooled to 30° C. over a period of 1 hour, the vessel contents are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a crystalline polyester resin dispersion liquid is obtained.

Preparation of Oily Phase

A vessel is charged with 50 parts of the release agent dispersion liquid, 150 parts of the non-linear amorphous polyester resin D-1, 500 parts of the crystalline polyester resin dispersion liquid, 750 parts of the linear amorphous polyester resin E-1, 50 parts of the master batch, and 2 parts of the ketimine 1. The vessel contents are mixed with TK HOMOMIXER (from PRIMIX Corporation) at 5,000 rpm for 60 minutes. Thus, an oily phase is obtained.

Preparation of Aqueous Dispersion Liquid of Vinyl Resin

A reaction vessel equipped with a stirrer and a thermometer is charged with 683 parts of water, 11 parts of a sodium salt of a sulfate of ethylene oxide adduct of methacrylic acid (ELEMINOL RS-30 from Sanyo Chemical Industries, Ltd.), 138 parts of styrene, 138 parts of methacrylic acid, and 1 part of ammonium persulfate. The vessel contents are stirred for 15 minutes at a revolution of 400 rpm. Next, the vessel contents are heated to 75° C. and subjected to a reaction for 5 hours. After adding 30 parts of 1% aqueous solution of ammonium persulfate, the vessel contents are aged at 75° C. for 5 hours. Thus, an aqueous dispersion liquid of a vinyl resin is prepared.

The vinyl resin particles in the aqueous dispersion liquid have a volume average particle diameter of 0.14 μm when measured by a laser diffraction particle size distribution analyzer LA-920 (from Horiba, Ltd.).

Preparation of Aqueous Phase

An aqueous phase is prepared by mixing and stirring 990 parts of water, 83 parts of the aqueous dispersion liquid of a vinyl resin, 37 parts of a 48.5% aqueous solution of dodecyl diphenyl ether sodium disulfonate (ELEMINOL MON-7 from Sanyo Chemical Industries, Ltd.), and 90 parts of ethyl acetate.

Emulsification and Solvent Removal

In a vessel, 1,052 parts of the oily phase is mixed with 1,200 parts of the aqueous phase by TK HOMOMIXER (from PRIMIX Corporation) at a revolution of 13,000 rpm for 20 minutes. Thus, an emulsion slurry is obtained.

The emulsion slurry is contained in a vessel equipped with a stirrer and a thermometer, and subjected to solvent removal at 30° C. for 8 hours and subsequent aging at 45° C. for 4 hours. Thus, a dispersion slurry is obtained.

Washing and Drying

The dispersion slurry in an amount of 100 parts is subjected to filtration under reduced pressures. The resulting filter cake is subjected to the following operations (1) to (4) twice.

(1) The filter cake is mixed with 100 parts of ion-exchange water using TK HOMOMIXER (from PRIMIX Corporation) at a revolution of 12,000 rpm for 10 minutes, followed by filtration;

(2) The filter cake of (1) is mixed with 100 parts of 10% aqueous solution of sodium hydroxide by TK HOMOMIXER (from PRIMIX Corporation) at a revolution of 12,000 rpm for 30 minutes, followed by filtration under reduced pressures;

(3) The filter cake of (2) is mixed with 100 parts of 10% hydrochloric acid by TK HOMOMIXER (from PRIMIX Corporation) at a revolution of 12,000 rpm for 10 minutes, followed by filtration; and (4) The filter cake of (3) is mixed with 300 parts of ion-exchange water using TK HOMOMIXER (from PRIMIX Corporation) at a revolution of 12,000 rpm for 10 minutes, followed by filtration.

The resulting filter cake is dried by a circulating air dryer at 45° C. for 48 hours and sieved with a mesh having an opening of 75 μm. Thus, mother particles are prepared.

External Treatment Process

Next, 100 parts of the mother particles are mixed with 1.0 part of a hydrophobized silica (HDK-2000 from Wacker Chemie AG) using a HENSCHEL MIXER (from Mitsui Mining & Smelting Co., Ltd.) at a peripheral speed of 30 m/s for 30 seconds, followed by a pause for 1 minute. This mixing treatment is repeated five times. The mixture is sieved with a mesh having an opening of 35 μm. Thus, a toner 10 is obtained.

Preparation of Toner 11

The procedure for preparing the toner 10 is repeated except that the amounts of the non-linear amorphous polyester resin D-1 and the linear amorphous polyester resin E-1 used for the preparation of the oily phase are changed to 120 parts and 780 parts, respectively. Thus, a toner 11 is prepared.

Preparation of Toner 12

The procedure for preparing the toner 10 is repeated except that the amounts of the non-linear amorphous polyester resin D-1 and the linear amorphous polyester resin E-1 used for the preparation of the oily phase are changed to 180 parts and 720 parts, respectively. Thus, a toner 12 is prepared.

Preparation of Toner 13

The procedure for preparing the toner 10 is repeated except that the non-linear amorphous polyester resin D-1 and the linear amorphous polyester resin E-1 are replaced with the non-linear amorphous polyester resin D-2 and the linear amorphous polyester resin E-3, respectively. Thus, a toner 13 is prepared.

Preparation of Toner 14

The procedure for preparing the toner 10 is repeated except that the amounts of the non-linear amorphous polyester resin D-1, the linear amorphous polyester resin E-1, and the crystalline polyester resin dispersion liquid used for the preparation of the oily phase are changed to 120 parts, 820 parts, and 100 parts, respectively. Thus, a toner 14 is prepared.

Preparation of Toner 15

The procedure for preparing the toner 10 is repeated except that the amounts of the non-linear amorphous polyester resin D-1, the linear amorphous polyester resin E-1, and the crystalline polyester resin dispersion liquid used for the preparation of the oily phase are changed to 180 parts, 750 parts, and 200 parts, respectively. Thus, a toner 15 is prepared.

Preparation of Toner 16

The procedure for preparing the toner 12 is repeated except that the non-linear amorphous polyester resin D-1 and the linear amorphous polyester resin E-1 are replaced with the non-linear amorphous polyester resin D-2 and the linear amorphous polyester resin E-3, respectively. Thus, a toner 16 is prepared.

Preparation of Toner 17

The procedure for preparing the toner 11 is repeated except that the linear amorphous polyester resin E-1 is replaced with the linear amorphous polyester resin E-2. Thus, a toner 17 is prepared.

Preparation of Toner 18

The procedure for preparing the toner 10 is repeated except that the non-linear amorphous polyester resin D-1 is replaced with the non-linear amorphous polyester resin D-2. Thus, a toner 18 is prepared.

Preparation of Toner 19

The procedure for preparing the toner 10 is repeated except that the linear amorphous polyester resin E-1 is replaced with the linear amorphous polyester resin E-2. Thus, a toner 19 is prepared.

Preparation of Toner 20

The procedure for preparing the toner 10 is repeated except that the amounts of the non-linear amorphous polyester resin D-1, the linear amorphous polyester resin E-1, and the crystalline polyester resin dispersion liquid used for the preparation of the oily phase are changed to 125 parts, 825 parts, and 0 parts, respectively. Thus, a toner 20 is prepared.

Preparation of Toner 21

The procedure for preparing the toner 16 is repeated except that the amounts of the non-linear amorphous polyester resin D-2 and the linear amorphous polyester resin E-3 are changed to 200 parts and 700 parts, respectively. Thus, a toner 21 is prepared.

Preparation of Toner 22 The procedure for preparing the toner 10 is repeated except that the non-linear amorphous polyester resin D-1 and the linear amorphous polyester resin E-1 are replaced with the non-linear amorphous polyester resin D-4 and the linear amorphous polyester resin E-3, respectively. Thus, a toner 22 is prepared.

Preparation of Toner 23

The procedure for preparing the toner 12 is repeated except that the non-linear amorphous polyester resin D-1 and the linear amorphous polyester resin E-1 are replaced with the non-linear amorphous polyester resin D-5 and the linear amorphous polyester resin E-5, respectively. Thus, a toner 23 is prepared.

Preparation of Toner 24

The procedure for preparing the toner 12 is repeated except that the non-linear amorphous polyester resin D-1 and the linear amorphous polyester resin E-1 are replaced with the non-linear amorphous polyester resin D-5 and the linear amorphous polyester resin E-4, respectively. Thus, a toner 24 is prepared.

Preparation of Toner 25

The procedure for preparing the toner 10 is repeated except that the non-linear amorphous polyester resin D-1 and the linear amorphous polyester resin E-1 are replaced with the non-linear amorphous polyester resin D-3 and the linear amorphous polyester resin E-2, respectively. Thus, a toner 25 is prepared.

Preparation of Toner 26

The procedure for preparing the toner 10 is repeated except that the amounts of the non-linear amorphous polyester resin D-1 and the linear amorphous polyester resin E-1 used for the preparation of the oily phase are changed to 80 parts and 820 parts, respectively. Thus, a toner 26 is prepared.

Preparation of Toner 27

The procedure for preparing the toner 17 is repeated except that the amounts of the non-linear amorphous polyester resin D-1 and the linear amorphous polyester resin E-2 used for the preparation of the oily phase are changed to 110 parts and 790 parts, respectively. Thus, a toner 27 is prepared.

The compositions and properties of the toners 10 to 27 are shown in Tables 1 and 2.

TABLE 1

| | Non-linear Amorphous Polyester Resin A | | Linear Amorphous Polyester Resin B | | Crystalline Polyester Resin C |
|---|---|---|---|---|---|
| Toner No. | Type | Parts in weight | Type | Parts in weight | Parts in weight |
| 10 | D-1 | 150 | E-1 | 750 | 50 |
| 11 | D-1 | 120 | E-1 | 780 | 50 |
| 12 | D-1 | 180 | E-1 | 720 | 50 |
| 13 | D-2 | 150 | E-3 | 750 | 50 |
| 14 | D-1 | 120 | E-1 | 820 | 10 |
| 15 | D-1 | 180 | E-1 | 750 | 20 |
| 16 | D-2 | 180 | E-3 | 720 | 50 |
| 17 | D-1 | 120 | E-2 | 780 | 50 |
| 18 | D-2 | 150 | E-1 | 750 | 50 |
| 19 | D-1 | 150 | E-2 | 750 | 50 |
| 20 | D-1 | 125 | E-1 | 825 | 0 |
| 21 | D-2 | 200 | E-3 | 700 | 50 |
| 22 | D-4 | 150 | E-3 | 750 | 50 |
| 23 | D-5 | 180 | E-5 | 720 | 50 |
| 24 | D-5 | 180 | E-4 | 720 | 50 |

TABLE 1-continued

| Toner No. | Non-linear Amorphous Polyester Resin A Type | Non-linear Amorphous Polyester Resin A Parts in weight | Linear Amorphous Polyester Resin B Type | Linear Amorphous Polyester Resin B Parts in weight | Crystalline Polyester Resin C Parts in weight |
|---|---|---|---|---|---|
| 25 | D-3 | 150 | E-2 | 750 | 50 |
| 26 | D-1 | 80 | E-1 | 820 | 50 |
| 27 | D-1 | 110 | E-2 | 790 | 50 |

TABLE 2

| Toner No. | THF-soluble Tg2nd | THF-insoluble G'(100) | G'(40) | G'(40)/G'(100) | Content (%) | Tg2nd | Toner Tg1st | Heat-resistant Storage Stability | Adhesion Force (gf) |
|---|---|---|---|---|---|---|---|---|---|
| 10 | 30 | 5.00E+05 | 1.55E+07 | 3.10E+01 | 23 | 3 | 43 | AA | 166.67 |
| 11 | 33 | 3.20E+06 | 1.12E+08 | 3.50E+01 | 20 | 5 | 45 | A | 120.00 |
| 12 | 28 | 3.80E+05 | 9.50E+06 | 2.50E+01 | 25 | 0 | 41 | A | 150.00 |
| 13 | 26 | 3.90E+05 | 8.97E+06 | 2.30E+01 | 22 | −7 | 35 | B | 176.47 |
| 14 | 35 | 4.80E+06 | 1.63E+08 | 3.40E+01 | 20 | 6 | 45 | AA | 50.00 |
| 15 | 46 | 7.00E+06 | 2.31E+08 | 3.30E+01 | 27 | −1 | 42 | AA | 107.14 |
| 16 | 27 | 2.80E+05 | 7.28E+06 | 2.60E+01 | 21 | −13 | 40 | A | 111.11 |
| 17 | 32 | 3.00E+06 | 1.02E+08 | 3.40E+01 | 27 | 6 | 44 | A | 107.14 |
| 18 | 28 | 4.80E+05 | 1.44E+07 | 3.00E+01 | 22 | −10 | 38 | AA | 150.00 |
| 19 | 29 | 5.20E+05 | 1.72E+07 | 3.30E+01 | 25 | 4 | 41 | AA | 136.36 |
| 20 | 35 | 6.80E+06 | 2.38E+08 | 3.50E+01 | 21 | 6 | 48 | AA | 40.91 |
| 21 | 22 | 4.00E+05 | 8.80E+06 | 2.20E+01 | 29 | −9 | 31 | B | 200.00 |
| 22 | 40 | 7.00E+04 | 4.55E+06 | 6.50E+01 | 30 | 33 | 47 | AA | 38.24 |
| 23 | 35 | 9.00E+07 | 6.30E+09 | 7.00E+01 | 25 | −49 | 29 | C | 200.00 |
| 24 | 33 | 7.50E+07 | 4.50E+09 | 6.00E+01 | 24 | −45 | 28 | C | 230.77 |
| 25 | 42 | 8.50E+04 | 1.28E+07 | 1.50E+02 | 12 | 32 | 53 | AA | 25.00 |
| 26 | 68 | 4.50E+05 | 1.44E+07 | 3.20E+01 | 13 | −35 | 50 | AA | 33.33 |
| 27 | 35 | 3.20E+06 | 1.12E+08 | 3.50E+01 | 29 | 7 | 46 | A | 93.75 |

Preparation of Carrier

A mixture of 100 parts of a silicone resin (organo straight silicone), 5 parts of γ-(2-aminoethyl)aminopropyl trimethoxysilane, 10 parts of a carbon black, and 100 parts of toluene is subjected to a dispersion treatment for 20 minutes using a HOMOMIXER, thus obtaining a protective layer coating liquid.

The protective layer coating liquid is applied to the surfaces of 1,000 parts of spherical ferrite having a volume average particle diameter of 35 μm using a fluidized-bed coating device. Thus, a carrier is prepared.

Preparation of Developer

Each of the toners 10 to 27 in an amount of 5 parts is mixed with the carrier in an amount of 95 parts, thus obtaining developers each including the toners 10 to 27.

Preparation of Fixing Belts 1 to 7

Preparation of Fixing Belt 1 A silicone primer resin DY 39-051 (from Dow Corning Toray Co., Ltd.) is applied to the surface of a polyimide base material having an outer diameter of 250 mm and a thickness of 35 μm and dried, thereby forming a first primer layer. A heat-resistant silicone resin DX 35-2083 (from Dow Corning Toray Co., Ltd.) is applied to the surface of the first primer layer and subjected to vulcanization, thereby forming an elastic later having a thickness of 250 μm. A PFA primer (from Du Pont-Mitsui Fluorochemicals Co., Ltd.) is applied to the surface of the elastic layer and dried, thereby forming a second primer layer. A PFA 340-J (from Du Pont-Mitsui Fluorochemicals Co., Ltd.) is applied to the surface of the second primer layer and baked at 340° C. for 30 minutes, thereby forming a release layer having a thickness of 7 μm. Thus, a fixing belt 1 is obtained. The fixing belt 1 has a Martens hardness of 0.8 N/mm$^2$.

Preparation of Fixing Belt 2

The procedure for preparing the fixing belt 1 is repeated except that the thickness of the release layer is changed to 30 μm. Thus, a fixing belt 2 is obtained. The fixing belt 2 has a Martens hardness of 2.0 N/mm$^2$.

Preparation of Fixing Belt 3

The procedure for preparing the fixing belt 1 is repeated except that the thickness of the elastic layer is changed to 350 μm. Thus, a fixing belt 3 is obtained. The fixing belt 3 has a Martens hardness of 0.7 N/mm$^2$.

Preparation of Fixing Belt 4

The procedure for preparing the fixing belt 1 is repeated except that the thicknesses of the elastic layer and release layer are changed to 350 μm and 15 μm, respectively. Thus, a fixing belt 4 is obtained. The fixing belt 4 has a Martens hardness of 1.2 N/mm$^2$.

Preparation of Fixing Belt 5

The procedure for preparing the fixing belt 1 is repeated except that the thicknesses of the elastic layer and release layer are changed to 350 μm and 30 μm, respectively. Thus, a fixing belt 5 is obtained. The fixing belt 5 has a Martens hardness of 1.8 N/mm$^2$.

Preparation of Fixing Belt 6

The procedure for preparing the fixing belt 1 is repeated except that the thickness of the elastic layer is changed to 500 μm. Thus, a fixing belt 3 is obtained. The fixing belt 6 has a Martens hardness of 0.5 N/mm$^2$.

Preparation of Fixing Belt 7

The procedure for preparing the fixing belt 1 is repeated except that the thicknesses of the elastic layer and release layer are changed to 500 μm and 30 μm, respectively. Thus, a fixing belt 7 is obtained. The fixing belt 7 has a Martens hardness of 1.5 N/mm$^2$.

The properties of the fixing belts 1 to 7 are shown in Table 3.

TABLE 3

| Fixing Belt No. | Thickness of Elastic Layer (μm) | Thickness of Release Layer (μm) | Martens Hardness ($N/mm^2$) |
|---|---|---|---|
| 1 | 250 | 7 | 0.8 |
| 2 | 250 | 30 | 2 |
| 3 | 350 | 7 | 0.7 |
| 4 | 350 | 15 | 1.2 |
| 5 | 350 | 30 | 1.8 |
| 6 | 500 | 7 | 0.5 |
| 7 | 500 | 30 | 1.5 |

Example 1

The fixing belt 1 is mounted on a fixing device of a digital color multifunction peripheral (Pro C5110S from Ricoh Co., Ltd.). A solid image having a toner deposition amount of 0.80±0.10 $mg/cm^2$ is formed by this digital color multifunction peripheral with the developer including the toner 10 on sheets of an embossed paper (LEATHAC 66 having a ream weight of 175 kg from Tokushu Tokai Paper Co., Ltd.). Each sheet having the solid image thereon is passed through the fixing device while varying the temperature of the fixing belt.

The sheet having passed the fixing device is then fixedly put on a plate of a drawing tester (AD-401 from Ueshima Seisakusho Co., Ltd.) equipped with a scratching sapphire needle for HEIDON (having a tip angle of 60° and a tip radius of 0.3 mm from Shinto Scientific Co., Ltd.) while setting the needle rotation radius to 8 mm and the load to 50 g. The handle of the drawing tester is rotated about 10 times at a rotation speed of 1 to 2 times per second. The fixed image having been subjected to the drawing test is strongly rubbed five times with a fabric HONECOTTO #440 (from Sakata Inx Eng. Co., Ltd.) to remove toner peeled off from the sheet in the drawing test. The lowest fixing temperature at which peeling-off of toner does not occur is defined as the lower-limit fixable temperature (or lower-limit drawable temperature).

The linear speed of the fixing device at the nip portion is 180 mm/s.

The surface pressure in the nip portion is adjusted by adjusting the distance between the axes of the fixing roller and the pressure roller. In particular, the surface pressure at the central part of the nip portion in the axial direction is adjusted to 1.5 $kgf/cm^2$, measured by a pressure mapping system I-SCAN (from Nitta Corporation).

Example 2

The procedure for forming fixed images in Example 1 is repeated except for changing the surface pressure to 2.5 $kgf/cm^2$.

The lower-limit fixable temperature is evaluated in the same manner as Example 1. Results are shown in Table 4.

Examples 3 to 21

The procedure for forming fixed images in Example 1 is repeated except for changing the types of toner and fixing belts and the surface pressure as described in Table 4. The lower-limit fixable temperature is evaluated in the same manner as Example 1. Results are shown in Table 4.

Comparative Examples 1 to 6

The procedure for forming fixed images in Example 1 is repeated except for changing the types of toner and fixing belts and the surface pressure as described in Table 4. The lower-limit fixable temperature is evaluated in the same manner as Example 1. Results are shown in Table 4.

TABLE 4

| | Toner No. | Fixing Belt No. | Surface Pressure (kgf/cm2) | Lowe-limit Fixable Temperature for Embossed Paper (° C.) |
|---|---|---|---|---|
| Example 1 | 10 | 1 | 1.5 | 145 |
| Example 2 | 10 | 1 | 2.5 | 140 |
| Example 3 | 10 | 2 | 2.5 | 146 |
| Example 4 | 10 | 3 | 1.5 | 144 |
| Example 5 | 10 | 3 | 2.5 | 139 |
| Example 6 | 10 | 4 | 2.5 | 142 |
| Example 7 | 10 | 5 | 2.5 | 145 |
| Example 8 | 10 | 6 | 1.5 | 143 |
| Example 9 | 10 | 6 | 2.5 | 138 |
| Example 10 | 10 | 7 | 2.5 | 143 |
| Example 11 | 11 | 3 | 2.5 | 146 |
| Example 12 | 12 | 3 | 2.5 | 141 |
| Example 13 | 13 | 3 | 2.5 | 138 |
| Example 14 | 15 | 3 | 2.5 | 149 |
| Example 15 | 16 | 3 | 2.5 | 148 |
| Example 16 | 17 | 3 | 2.5 | 149 |
| Example 17 | 18 | 3 | 2.5 | 141 |
| Example 18 | 19 | 3 | 2.5 | 143 |
| Example 19 | 21 | 3 | 2.5 | 136 |
| Example 20 | 23 | 3 | 2.5 | 136 |
| Example 21 | 24 | 3 | 2.5 | 134 |
| Comparative Example 1 | 14 | 3 | 2.5 | 151 |
| Comparative Example 2 | 20 | 3 | 2.5 | 154 |
| Comparative Example 3 | 22 | 3 | 2.5 | 155 |
| Comparative Example 4 | 25 | 3 | 2.5 | 161 |
| Comparative Example 5 | 26 | 3 | 2.5 | 157 |
| Comparative Example 6 | 27 | 3 | 2.5 | 153 |

The results shown in Table 4 indicate that, in Examples 1 to 21, the toners are fixed on the embossed paper with sufficient strength even at low temperatures, i.e., the toners exhibit excellent low-temperature fixability.

By contrast, in Comparative Examples 1 to 5, the toners are poor in low-temperature fixability because the adhesion force of the toners is less than 100 gf, where the adhesion force is defined as the maximum value of a pull force between a layer of the toner and standard paper determined by a tacking test with a probe temperature of 140° C.

It is clear from these experimental results that as the adhesion force increases, the lower-limit fixable temperature (or lower-limit drawable temperature) decreases. The lower-limit drawable temperature refers to the lowest fixable temperature at which not only cold offset does not occur but also highly-durable image is obtained which neither peels off nor gets contaminated even when scratched with a pen. In general, when the adhesion force of toner is low, cold offset or peeling-off of image is likely to occur at concave portions on the surface-irregular paper. Because the toners in accordance with some embodiments of the present invention exhibit a high adhesion force, neither cold offset nor peeling-off of image occurs even at concave portions on the surface-irregular paper.

What is claimed is:

1. An image forming method, comprising:

forming an electrostatic latent image on a photoconductor;

developing the electrostatic latent image into a toner image with a toner exhibiting an adhesion force of 100 gf or more, the adhesion force being the maximum value of a pull force between a layer of the toner and standard paper determined by a tacking test with a probe temperature of 140° C.;

transferring the toner image onto a recording medium having a smoothness of 20 s or less; and fixing the toner image on the recording medium, wherein said method is further characterized by any one of the following conditions a), b), c), or d):

a) the toner comprises:

a non-linear amorphous polyester resin A; and a linear amorphous polyester resin B, wherein THF-insoluble material in the toner has a glass transition temperature, measured in a second heating of differential scanning calorimetry, in the range of −40° C. to 30° C., and wherein the THF-insoluble material satisfies the following inequations:

$$1\times10^5\ (\mathrm{Pa}) \leq G'(100) \leq 1\times10^7\ (\mathrm{Pa})$$

$$G'(40)/G'(100) \leq 3.50\times10$$

wherein G'(40) and G'(100) represent storage elastic modulus of the THF-insoluble at 40° C. and 100° C., respectively;

b) the toner further includes a crystalline polyester resin C, and wherein THF-soluble material in the toner has a glass transition temperature, measured in a second heating of differential scanning calorimetry, in the range of 20° C. to 35° C.

c) in the fixing, the toner image is fixed on the recording medium with a fixing belt having a release layer having an average thickness t2 of 10 μm or less;

d) in the fixing the toner image is fixed on the recording medium with a fixing belt having a Martens hardness of 1.0 $N/mm^2$ or less.

2. The image forming method according to claim 1, wherein said method is further characterized by condition a).

3. The image forming method according to claim 1, wherein said method is further characterized by condition b).

4. The image forming method according to claim 1, wherein said method is further characterized by condition c).

5. The image forming method according to claim 1, wherein said method is further characterized by condition d).

* * * * *